US007627260B2

(12) United States Patent
Shiraishi et al.

(10) Patent No.: US 7,627,260 B2
(45) Date of Patent: Dec. 1, 2009

(54) DEVELOPMENT APPARATUS, PROCESS CARTRIDGE, AND IMAGE FORMING APPARATUS

(75) Inventors: Emiko Shiraishi, Kanagawa (JP); Hirokatsu Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 171 days.

(21) Appl. No.: 11/751,223

(22) Filed: May 21, 2007

(65) Prior Publication Data

US 2007/0274741 A1 Nov. 29, 2007

(30) Foreign Application Priority Data

May 23, 2006 (JP) ..... 2006-142692

(51) Int. Cl.
*G03G 15/08* (2006.01)

(52) U.S. Cl. ..... 399/58; 399/53; 399/254

(58) Field of Classification Search ..... 399/53, 399/58, 61, 63, 107, 119, 120, 254–256, 399/258–260

See application file for complete search history.

(56) References Cited

U.S. PATENT DOCUMENTS

| | | | | |
|---|---|---|---|---|
| 5,887,224 | A * | 3/1999 | Mizuishi et al. | 399/62 |
| 5,937,228 | A | 8/1999 | Shoji et al. | |
| 5,970,280 | A | 10/1999 | Suzuki et al. | |
| 6,366,751 | B1 | 4/2002 | Shakuto et al. | |
| 6,757,509 | B2 | 6/2004 | Shoji et al. | |
| 7,212,753 | B2 | 5/2007 | Suzuki et al. | |
| 2002/0181968 | A1* | 12/2002 | Okimura et al. | 399/111 |
| 2005/0207794 | A1* | 9/2005 | Katoh et al. | 399/254 |
| 2005/0254846 | A1 | 11/2005 | Yura et al. | |
| 2006/0008281 | A1* | 1/2006 | Matsumoto et al. | 399/27 |
| 2007/0014596 | A1 | 1/2007 | Sohmiya et al. | |
| 2007/0025776 | A1 | 2/2007 | Suzuki | |
| 2007/0098449 | A1* | 5/2007 | Kadota et al. | 399/254 |

FOREIGN PATENT DOCUMENTS

| | | |
|---|---|---|
| JP | 6-6380 | 2/1994 |
| JP | 2006-251440 | 9/2006 |

OTHER PUBLICATIONS

Machine Translation of H6-6380.*

* cited by examiner

*Primary Examiner*—David M Gray
*Assistant Examiner*—Gregory H Curran
(74) *Attorney, Agent, or Firm*—Oblon, Spivak, McClelland, Maier & Neustadt, L.L.P.

(57) ABSTRACT

A development apparatus can uniform a toner density by controlling the phase of a toner density fluctuation, and can inhibit fluctuation of the toner density and variation of the toner charge amount. The development apparatus is configured to have a phase control mechanism, which forms a dividing point at a predetermined point (e.g., an opening section provided on a partition plate between two screws) in a flow of a developer within the development apparatus in which a toner density fluctuates spatially due to toner replenishment or toner consumption caused by development, causes the developer divided at the dividing point to pass through different paths (path 1, path 2), thereby shifts a phase of the fluctuation of the toner density within the developer, and thereafter causes thus obtained developers having shifted phases to merge with each other, to perform phase control. The developers spatially having toner density fluctuations are superimposed with shifted phases, thereby a high toner density and a low toner density are averaged so that the toner density is uniformed.

21 Claims, 22 Drawing Sheets

$$SF\text{-}2 = \frac{(PERI)^2}{AREA} \times \frac{1}{4\pi} \times 100$$

$$SF\text{-}1 = \frac{(MXLNG)^2}{AREA} \times \frac{\pi}{4} \times 100$$

INDEPENDENT REPLENISHMENT OF CARRIER

PREMIXING

DEVELOPMENT APPARATUS, PROCESS CARTRIDGE, AND IMAGE FORMING APPARATUS

BACKGROUND OF THE INVENTION

1. Field of the Invention

The present invention relates to a development apparatus for performing development using a two-component developer composed of toner and carrier, a process cartridge having the development apparatus, and an image forming apparatus with this development apparatus or process cartridge, such as an electrophotographic copying machine, printer, plotter, facsimile machine, or complex machine with a combination of these machines. The present invention further relates to an image forming apparatus having a plurality of the development apparatuses or process cartridges and capable of forming color images.

2. Description of the Related Art

As a development apparatus of a biaxially-conveying type that performs development using a two-component developer, there has conventionally been known a configuration in which two developer conveying members (screws, augers, or the like) and two conveying paths are disposed substantially in a horizontal direction below a developer supporting body (a developing roller, a sleeve, or the like), one of the developer conveying members (screws, augers, or the like) being used for supplying and recovering a developer to and from the developer supporting body, while the other one being used for conveying and stirring the developer after toner is replenished, and one of the conveying paths being a supplying/recovering conveying path, while the other one being a stirring/conveying path.

In such a biaxially-conveying type development apparatus, the toner density of the developer within the development apparatus spatially fluctuates due to replenishment of toner or consumption of toner (development). For this reason, reduction of fluctuation of the toner density was conventionally performed by diffusing the developer by means of the developer conveying members (screws, augers, or the like). In order to improve the diffusion capacity of the developer conveying members such as screws, the number of rotations of the screws can be increased or the shape of the screws can be changed creatively by attaching fins or the like. However, there is a limit to such ideas, thus the developer cannot be diffused sufficiently before reaching the developer supporting body (a developing roller, a sleeve, or the like), whereby the toner density fluctuation may still be observed in the developer drawn up to the developer supporting body.

Therefore, there has been proposed in, for example, Examined Utility Model Application Publication No. H6-6380 a development apparatus of a biaxially-conveying type in which, in order to reduce the toner density variation occurring in the axial direction of the developer supporting body, a plurality of opening sections are provided on a partition plate (partition wall) provided between two screws, and a guide member that inclines to the partition plate in a developer conveying direction and guides a developer to the opening members is also provided.

In the conventional development apparatus with the biaxial configuration, the developer does not flow divergingly on the developer conveying members (e.g., screws), whereby the waveforms of the toner density fluctuation that are formed on the screws due to toner replenishment or consumption are kept as is. Then, only the amplitude of the waveforms are reduced by means of stirring/conveying using the screws while keeping the waveforms, thus it is necessary to cause the developer to circulate within the development apparatus a number of times until the amplitude of the waveforms becomes vanishingly small.

The conventional technology described in the above Examined Utility Model Application Publication No. H6-6380 is intended to reduce the variation occurring in the axial direction of the sleeve of the biaxial development apparatus, and has the opening sections on the partition plate, but does not control the phase of the toner density fluctuation. Specifically, in order to achieve the above object, it is essential that the developer flows from the screw, which is far from the sleeve, to the screw on the sleeve side via the opening sections, thus it is necessary to cause the developer to circulate within the development apparatus a number of times until the amplitude of the waveforms becomes vanishingly small.

SUMMARY OF THE INVENTION

The present invention was contrived in view of such circumstances, and an object thereof is to provide a development apparatus, a process cartridge having the development apparatus, and an image forming apparatus, the development apparatus having a configuration that can instantly uniform a toner density by controlling the phase of a toner density fluctuation, and sufficiently inhibit fluctuation of the toner density and variation of a toner charge amount before drawing a developer up to a developer supporting body.

Another object of the present invention is to provide toner, carrier, and developer that are suitable to be used in the development apparatus, process cartridge, and image forming apparatus.

In an aspect of the present invention, a development apparatus develops and visualizes a latent image formed on a latent image supporting body, by using a two-component developer composed of toner and carrier. The development apparatus comprises a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control.

In another aspect of the present invention, a carrier is used in a development apparatus for developing and visualizing a latent image formed on a latent image supporting body, by using a two-component developer composed of toner and the carrier. A volume average particle diameter of the carrier is 20 through 60 μm. The development apparatus has a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control.

In another aspect of the present invention, a toner is used in a development apparatus for developing and visualizing a latent image formed on a latent image supporting body, by using a two-component developer composed of toner and the carrier. A volume average particle diameter of the toner is 3 through 8 μm, the ratio between the volume average particle diameter and a number average particle diameter is in a range of 1.00 through 1.40. The development apparatus has a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control.

In another aspect of the present invention, a toner is used in a development apparatus for developing and visualizing a latent image formed on a latent image supporting body, by using a two-component developer composed of toner and the carrier. A shape factor SF-1 is within a range of 100 through 180, a shape factor SF-2 is within a range of 100 through 180. The development apparatus has a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control.

In another aspect of the present invention, a toner is used in a development apparatus for developing and visualizing a latent image formed on a latent image supporting body, by using a two-component developer composed of toner and the carrier. Fine particles having an average primary particle diameter of 50 through 500 nm and a bulk density of at least 0.3 g/cm$^3$ are externally adhered to a toner host particle surface. The development apparatus has a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control.

In another aspect of the present invention, a process cartridge integrally has a latent image supporting body, a surface of which is formed with an electrostatic latent image, and a development apparatus that develops and visualizes the electrostatic latent image formed on the latent image supporting body, by using a two-component developer composed of toner and carrier. The development apparatus has a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control.

In another aspect of the present invention, an image forming apparatus has a latent image supporting body, a surface of which is formed with an electrostatic latent image, a development apparatus that develops and visualizes the electrostatic latent image formed on the latent image supporting body, by using a two-component developer composed of toner and carrier, or a process cartridge that integrally has the latent image supporting body and the development apparatus. The development apparatus has a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
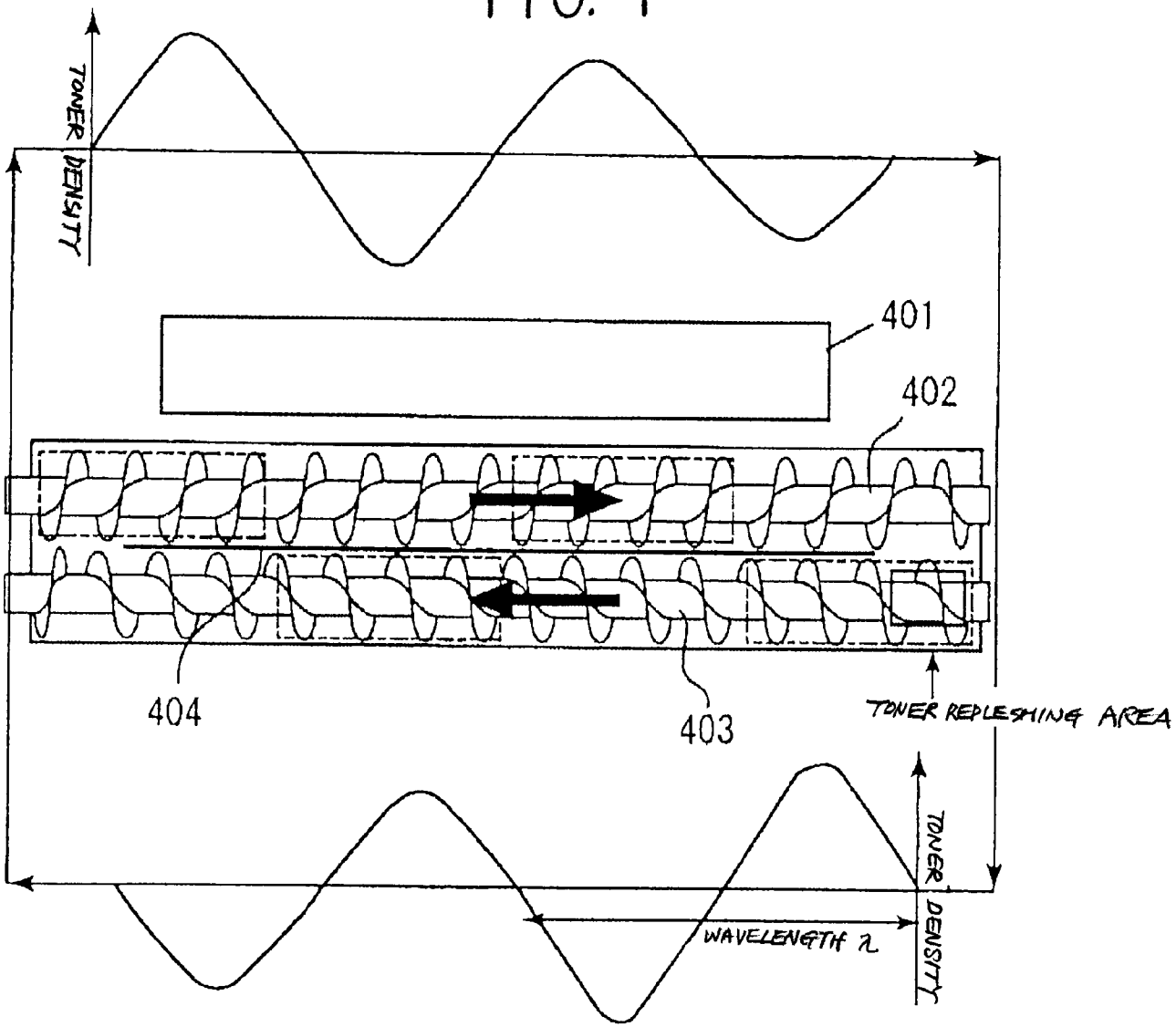
FIG. 1 is a figure for explaining a toner density fluctuation and phase control thereof within a development apparatus according to the present invention.

Hereinafter, means for achieving the abovementioned objects of the present invention and effects are described in detail.

A toner density of a developer within a development apparatus fluctuates spatially due to replenishment of toner or consumption of toner (development). In the past, reduction of fluctuation of the toner density was performed by diffusing the developer by means of developer conveying members (e.g., screws). In order to improve the diffusion capacity of the screws, the number of rotations of the screws can be increased or the shape of the screws can be changed creatively by attaching fins or the like. However, there is a limit to such ideas, thus the developer cannot be diffused sufficiently before reaching the developer supporting body (e.g., a sleeve of a developing roller), whereby the toner density fluctuation may still be observed in the developer drawn up to the developer supporting body.

Therefore, first means of the present invention is configured to have a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby changes a phase of the fluctuation of the toner density within the developer, and then causes thus obtained developers having shifted phases to merge with each other, to perform phase control. The developers spatially having toner density fluctuations are superimposed with shifted phases, thereby a high toner density and a low toner density are averaged so that the toner density is uniformed. A toner diffusion effect, which is obtained by changing the phase and superimposing the developers, is more significant than an effect obtained by stirring the developer using screws. Therefore, the fluctuation of the toner density of the developer drawn up to a sleeve becomes vanishingly small, and, consequently, the sate of charging is uniformed.

In order to reduce the fluctuation of the toner density of the developer within the development apparatus, it is necessary to divide the flow of the developer, change the phases thereof, and superimpose the developers on one another, as described above.

Therefore, in second means of the present invention, the development apparatus is configured to have at least: a developer supporting body (e.g., a sleeve of a developing roller) that rotates while supporting the developer, and supplies the toner of the developer to a latent image formed on a latent image supporting body (e.g., a photoconductor) at a position facing the latent image supporting body, to perform development; two developer conveying members (e.g., screws) that are disposed in parallel with the developer supporting body and convey the developer in directions different from each other; and a partition plate that is disposed between the two developer conveying members, wherein developer passing sections on both ends in axial directions of the pair of developer conveying members, and at least one opening section is provided as the phase control mechanism on the partition plate. By providing the opening section on the partition plate, the path of the developer can differ between a case in which the developer passes through the opening section and a case in which the developer does not pass through the opening section, thus, as a result, the phase of the toner density fluctuation can be changed.

In order to reduce the fluctuation of the toner density of the developer within the development apparatus, it is necessary to provide the opening section on the partition plate, divide the flow of the developer, change the phases thereof, and superimpose the developers on one another, as described above. However, simply providing the opening section on the partition plate may cause a small amount of developer to pass through the opening section, and obtain a small effect by changing the phase (the best effect is that an even amount of developer passes through the two paths).

In third means of the present invention, the two developer conveying members are screw-like members, each of which has a spiral blade section at a rotation axis section and conveys the developer in the axial direction by being rotated, and either one or both of the two developer conveying members (screws) facing the opening section on the partition plate are attached with fins. By attaching the fins to the screws facing the opening section, the amount of developer passing through the opening section increases, and the weight of developer passing through the two paths (the path on which the developer does not pass through the opening section, and the path on which the developer passes through the opening section) is substantially uniformed, thus a significant diffusion effect can be obtained by changing the phase.

In order to reduce the fluctuation of the toner density of the developer within the development apparatus, it is necessary to divide the flow of the developer, change the phases thereof, and superimpose the developers on one another, as described above. It is the most effective to shift the phase by Π. In order to shift the phase by Π, the position of the opening section needs to be determined such that a gap between the divided paths is $\lambda/2+\lambda\cdot n$ (λ: a wavelength that indicates a toner density fluctuation on the screws, n=0, 1, 2, . . . ).

Fourth means of the present invention is characterized in that a center position x of the opening section on the partition plate is located within a distance of $(1/8+1/2\cdot n)\lambda \leqq x \leqq (3/8+1/2\cdot n)\lambda$ (λ: a wavelength that indicates a toner density fluctuation on each of the developer conveying members, n=0, 1, 2, . . . ) from a center position of an opening section of an end section of the development apparatus. However, in fifth means of the present invention, in the case in which the wavelength λ varies due to the difference in developer conveying speed between the two developer conveying members, the wavelength λ is obtained as an average value of wavelengths λ1 and λ2 of the toner density fluctuations on the both developer conveying members: $\lambda=(\lambda 1+\lambda 2)/2$. In this manner, by setting the opening section at this position described above, the phase θ can be shifted by $1/2\cdot\Pi \leqq \theta \leqq 3/2\cdot\Pi$, thus a high diffusion effect can be expected.

Incidentally, there is a risk that, by providing the opening section on the partition plate as described above, after the replenished toner slides and passes through the opening section, the toner may be drawn up to the developer supporting body (e.g., sleeve) before being mixed with the carrier sufficiently.

Therefore, sixth means of the present invention is characterized in that the opening section of the partition plate is openable and closable, so that, by closing the opening section when the replenished toner passes by the opening section, the replenished toner can be prevented from being drawn up to the sleeve before being mixed with the carrier.

Furthermore, seventh means of the present invention is characterized in, in addition to the above-described configuration, that opening/closing of the partition plate is controlled in accordance with a toner replenishment timing, wherein, after a predetermined time lag since the time when the toner is replenished, the replenished toner passes by the opening section. By closing the opening section when the replenished toner passes through the opening section, the replenished toner can be prevented from being drawn up to the sleeve before being mixed with the carrier. The time lag here is determined by (the distance between the position where the toner is replenished and the opening section [m])/(developer conveying speed [m/s]).

There is a risk that, by providing the opening section on the partition plate as described above, after the replenished toner slides and passes through the opening section, the toner may be drawn up to the developer supporting body (e.g., sleeve) before being mixed with the carrier sufficiently.

Therefore, eighth means of the present invention is characterized in that, if the developer conveying member of the two developer conveying members, which is located proximate to the developer supporting body (e.g., sleeve), is taken as a first developer conveying member (e.g., screw A), and the other developer conveying member that is located distant from the developer supporting body (sleeve) is taken as a second developer conveying member (e.g., screw B), a rotation direction of the second developer conveying member (screw B) is a clockwise rotation, when viewed from a side of a state in which the sleeve is disposed on the left and the screw B on the right. When rotating the screw in this rotation direction, the developer is pulled toward the sleeve side of the screw B, while the replenished toner is pulled toward the side opposite to the sleeve where the surface of the developer is low. For this reason, the amount of replenished toner sliding and passing through the opening section becomes substantially 0.

In order to reduce the fluctuation of the toner density of the developer within the development apparatus, it is necessary to divide the flow of the developer, change the phases thereof, and superimpose the developers on one another, as described above.

Therefore, ninth means of the present invention is characterized in that the distance between an end section of the partition plate and a side face of a case is at least twice an external diameter of each of the developer conveying members (e.g., screws). By forming a large opening at the end section, the developer flowing around the outside and the inside of the opening of the end section generates the gap between the paths without forming another opening section on the partition plate, whereby the phase can be shifted.

In order to reduce the fluctuation of the toner density of the developer within the development apparatus, it is necessary to divide the flow of the developer, change the phases thereof, and superimpose the developers on one another, as described above.

Here, if a developer pool is formed on the sleeve, this developer pool on the sleeve functions as the phase control mechanism. This is because the developer pool has a function of creating two paths for a developer flowing directly over the screw A and for a developer drawn up to the sleeve, caused to circulate inside the developer pool, and then sent back to the screw A. However, in order to allow the developer pool on the sleeve to effectively function as the phase control mechanism, the amount of the developer dawn up from the screw A to the sleeve and then sent back to the screw A needs to be somewhat larger. As an indication of this amount, it is considered that, in the process in which the developer flows from the upstream to the downstream of the screw A, the weight of the developer X/u falling from the sleeve onto the screw A (per unit length) need to be approximately at least half the weight of the developer Y that is originally accumulated at the screw A (the developer weight per unit length).

Tenth means of the present invention is characterized in that, when a developer conveying member of the pair of developer conveying members (screws), which is located proximate to the sleeve, is taken as the screw A, the relationship among the amount per unit time of the developer X[kg/s] falling from the developer pool of the sleeve onto the screw A, the weight per unit length of the developer Y[kg/m] on the screw A, and the speed of conveying the developer on the screw A u[m/s] is expressed as $X/u \geqq 1/2\cdot Y$ (however, in eleventh means of the present invention, when the weight per unit length of the developer on the screw A fluctuates according to location, an average value of the weight per unit length of the developer in a longitudinal direction is expressed as a developer weight Y[kg/m]). Accordingly, the developer pool on the sleeve effectively functions as the phase control mechanism.

In order to reduce the fluctuation of the toner density of the developer within the development apparatus, it is necessary to divide the flow of the developer, change the phases thereof, and superimpose the developers on one another, as described above. It is the most effective to shift the phase by Π. In order to do so, measures need to be conducted to increase the gap between the paths so as to approximate the gap between the paths to λ/2 (λ: a wavelength that indicates a toner density fluctuation on the screws).

Therefore, twelfth means of the present invention is characterized in having: a developer regulating member (e.g. a doctor) that regulates the thickness of the developer of the developer pool formed on the sleeve; and excess developer recovering means for recovering excess developer formed in the vicinity of the developer regulating member, wherein the excess developer recovering means returns recovered developer to the conveying path of the first developer conveying member (screw A), and returns at least some of the developer from a recovered position to an upstream side of the conveying direction of the first developer conveying member (screw A) By causing the recovered developer of the developer pool formed on the sleeve to circulate from the recovered position to the upstream side of the conveying direction of the screw A, the gap between the paths can be increased and the phase can be further shifted.

In order to reduce the fluctuation of the toner density of the developer within the development apparatus, it is necessary to divide the flow of the developer, change the phases thereof, and superimpose the developers on one another, as described above. It is the most effective to shift the phase by H. In order to do so, measures need to be conducted to adjust the gap between the paths.

Therefore, thirteenth means of the present invention is characterized in, in addition to the above-described configuration of the twelfth means, that when the excess developer is returned from the position where the developer is recovered by the excess developer recovering means to the upstream side of the conveying direction of the first developer conveying member (screw A), the relationship among a distance x between the recovered position and a returned position, an average time t between when the developer is drawn up to the developer pool of the developer supporting body (sleeve) and when the developer falls onto the first developer conveying member (screw A), and the speed u of conveying the developer positioned on the first developer conveying member (screw A) satisfies $\lambda/4+\lambda\cdot n \leqq u\cdot t+x \leqq 3\lambda/4+\lambda\cdot n$ ($\lambda$: a wavelength that indicates a toner density fluctuation on the screws A). By setting the position for circulating the excess developer to this position described above, the phase $\theta$ can be shifted by $\frac{1}{2}\cdot\Pi \leqq \theta \leqq 3/2\cdot\Pi$ as with the fourth means, thus a high diffusion effect can be expected.

Fourteenth means of the present invention is the development apparatus according to any of the first to thirteenth means, characterized in having: the developer supporting body that rotates while supporting the developer, and supplies the toner of the developer to a latent image formed on a latent image supporting body at a position facing the latent image supporting body, to perform development; and the two developer conveying members disposed in parallel with the developer supporting body, one of which is for supplying and recovering the developer to and from the developer supporting body, and the other one is for conveying and stirring the developer after the toner is replenished, wherein the two developer conveying members are disposed in a horizontal direction below the developer supporting body (so-called biaxially-conveying type). The partition plate of the biaxially-conveying type development apparatus is provided with the opening section for controlling the phase, whereby the following effects can be achieved in addition to the above-described effects.

In the biaxially-conveying type development apparatus, the developer obtained after development is recovered by the supplying/recovering screw (screw A), whereby the toner density decreases as the developer flows toward the downstream of the screw, and a toner density fluctuation occurs on the right and left of the sleeve. However, by providing the opening section on the partition plate, the developer having a high toner density flows to the supplying/recovering screw, whereby the toner density fluctuation is reduced on the right and left of the sleeve. Therefore, a toner image can be stably formed.

Fifteenth means of the present invention is the development apparatus according to any of the first to thirteenth means, characterized in having: the developer supporting body that rotates while supporting the developer, and supplies the toner of the developer to a latent image formed on a latent image supporting body at a position facing the latent image supporting body, to perform development; and three developer conveying members, i.e., a supplying developer conveying member that is disposed in parallel with the developer supporting body and supplies the developer to the developer supporting body, a recovering developer conveying member that recovers the developer from the developer supporting body after development and conveys the recovered developer in a direction parallel with and same as the direction of the supplying developer conveying member, and a stirring developer conveying member that stirs and conveys excess developer, which is not supplied from the supplying developer conveying member to the developer supporting body, and the developer conveyed from the recovering developer conveying member, in a direction opposite to that of the supplying developer conveying member (so-called triaxially-conveying type). The partition plate of the triaxially-conveying type development apparatus is provided with the opening section for controlling the phase, whereby the following effects can be achieved in addition to the above-described effects.

In the triaxially-conveying type development apparatus, the developer that is drawn up to the sleeve is collected by the recovering screw but is not sent back to the supplying screw, thus the amount of developer decreases as the developer flows to the downstream of the supplying screw. Therefore, there is a risk that the developer runs dry in the downstream section. In order to prevent such depletion, it is necessary to increase the number of rotations of the screws, but there is a limit to such idea when considering the life of the axle bearing. However, by providing the opening section on the partition plate, the developer can be moved from the opening section to the supplying section, thus providing the opening section is extremely advantageous in preventing the developer from drying out.

Sixteenth means of the present invention is the development apparatus according to any of the first to fifteenth means, characterized in having: developer supplying means for supplying unused and previously mixed developer; and developer discharging means for discharging the developer within the development apparatus to the outside of the development apparatus, wherein deteriorated developer is discharged and the unused and previously mixed developer is supplied, whereby image formation can be performed with less deteriorated developer while keeping the amount of the developer within the development apparatus constant. Accordingly, it is possible to obtain a development apparatus in which fluctuations of the characteristics of the developer can be reduced and an image density that is stable for long period of time is obtained. Furthermore, by using the previously mixed developer, the number of containers required for replenishing the developer can be reduced, and a compact-sized development apparatus in which control can be performed easily can be achieved.

Seventeenth means is the development apparatus according to any of the first to fifteenth means, characterized in having developer supplying means constituted by a carrier supply section that supplies unused carrier and a toner supply section that supplies unused toner, wherein an operation for replenishing the carrier and an operation for replenishing the toner are controlled independently. By independently controlling the operation for replenishing the carrier and the operation for replenishing the toner, the developer can be replenished in accordance with a state of toner consumption, and image formation can be performed with less deteriorated developer while keeping the toner density within the development apparatus constant. Accordingly, it is possible to obtain a development apparatus in which fluctuations of the characteristics of the developer can be reduced and an image density that is stable for a long period of time is obtained.

Eighteenth means of the present invention is a carrier that is used in the development apparatus of any of the first to seventeenth means, characterized in that a volume average particle diameter is 20 to 60 μm. By using a carrier having small diameter, the development capacity can be improved by a dense magnetic brush, thus the amount of developer required for development (drawn-up amount) can be reduced. Accordingly, the number of rotations of the screws of the recovering section can be reduced, contributing to the reduction of stress related to the circulation of the developer. Also, the amount of the developer that passes through the developer regulating member to which stress is applied can be reduced, contributing to the increase of the life of the development apparatus. Since the volume of the carrier is reduced, the size of the devices such as a carrier storage section can be reduced. In addition, the magnetic brush is densified in a development area, thus a high-quality image and stable quality can be achieved. It should be noted that if the average particle diameter of the carrier is larger than 60 μm, the developer tends to overflow at a developer circulating section, whereby the developer cannot be circulated stably. Moreover, the magnetic brush becomes coarse, whereby satisfactory image quality cannot be obtained. On the other hand, if the average particle diameter of the carrier is smaller than 20 μm, the carrier adheres to the photoconductor, whereby a trouble occurs that the carrier scatters or may easily scatter from the development apparatus.

Nineteenth means of the present invention is a toner that is used in the development apparatus of any of the first to seventeenth means, characterized in that a volume average particle diameter (D4) is 3 to 8 μm and the ratio between the volume average particle diameter (D4) and a number average particle diameter (D1) (D4/D1) is in a range of 1.00 to 1.40. By using a toner having a small particle diameter and sharp particle diameter, the space between toner particles becomes small, thus a required amount of toner to be adhered can be reduced without damaging the color reproducibility. Accordingly, density fluctuations related to development can be reduced. Also, stable reproducibility of a minute dot image can be improved, and high quality that remains stable for a long period of time can be obtained. It should be noted that if the average particle diameter (D4) is less than 3 μm, the transfer efficiency and blade cleaning properties may deteriorate easily. If the average particle diameter (D4) exceeds 8 μm, fluidity of the developer is reduced, and it becomes difficult to prevent characters or lines from scattering and to maintain the stable image quality for a long period of time.

Twentieth means of the present invention is the toner that is used in the development apparatus of any of the first to seventeenth means, characterized in that a shape factor SF-1 is within a range of 100 to 180, and a shape factor SF-2 is within a range of 100 to 180. Since the toner is in nearly a spherical form, the fluidity of the developer improves, whereby the stress involved in circulation of the developer is reduced, and stable developer circulation and development can be achieved for a long period of time.

Twenty-first means of the present invention is the toner that is used in the development apparatus of any of the first to seventeenth means, characterized in that fine particles having an average primary particle diameter of 50 to 500 nm and a bulk density of at least 0.3 g/cm$^3$ are externally adhered to a toner host particle surface. Immersion of the external additive in the toner is small, and changes in the fluidity and charging characteristics of the developer become small over time, thus stable developer circulation and development can be achieved for a long period of time.

Twenty-second means of the present invention is the developer that is used in the development apparatus of any of the first to seventeenth means, characterized in that the carrier of the eighteenth means and the toner of any of the nineteenth to twenty-first means are used, and the same effects as the eighteenth means, and the nineteenth to twenty-first means can be achieved.

Twenty-third means of the present invention is the development apparatus according to any of the first to seventeenth means, characterized in that the developer of the twenty-second means is used as the developer, and the same effects as the eighteenth means, and the nineteenth through twenty-first means can be achieved.

Twenty-fourth means of the present invention is a process cartridge that integrally has a latent image supporting body, a surface of which is formed with an electrostatic latent image, and a development apparatus that develops and visualizes the electrostatic latent image formed on the latent image supporting body, by using a two-component developer composed of toner and carrier, wherein the process cartridge has the development apparatus of any of the first through seventeenth means or of the twenty-third means. By using the development apparatus of any of the first through seventeenth means or of the twenty-third means, the toner adhesion amount that is always stable for a long period of time can be obtained, thus a process cartridge having a stable image density can be provided.

Twenty-fifth means of the present invention is an image forming apparatus that has a latent image supporting body, a surface of which is formed with an electrostatic latent image, and a development apparatus that develops and visualizes the electrostatic latent image formed on the latent image supporting body, by using a two-component developer composed of toner and carrier, the image forming apparatus being characterized in having the development apparatus of any of the first through seventeenth means or of the twenty-third means and the process cartridge of the twenty-fourth means. By using the development apparatus of any of the first through seventeenth means or of the twenty-third means, and by using the process cartridge of the twenty-fourth means, the toner adhesion amount that is always stable for a long period of time can be obtained, thus an image forming apparatus having a stable image density can be provided.

Twenty-sixth means of the present invention is the image forming apparatus according to the twenty-fifth means, having a plurality of development apparatuses or process cartridges having different developing colors, and being characterized in forming a color image on a recording material. By using the development apparatus of any of the first through seventeenth means or of the twenty-third means as the plurality of development apparatuses, the toner adhesion amount that is always stable for a long period of time can be obtained, thus it is possible to provide an image forming apparatus that has a stable image density and is capable of obtaining high-quality color image with excellent color reproducibility and color balance can be provided.

Twenty-seventh means of the present invention is the image forming apparatus according to the twenty-fifth means, having a plurality of image forming units or process cartridges that have at least the latent image supporting body and the development apparatus that develops the electrostatic latent image formed on the latent image supporting body, and being characterized in forming an image having different developing colors by means of each of the image forming units or process cartridges, transferring the image onto the recording material directly or by means of an intermediate transfer body, and thereby forming a color image on the recording material. By using the development apparatus of any of the first through seventeenth means or of the twenty-third means as the development apparatus of each of the image forming units or process cartridges, the toner adhesion amount that is always stable for a long period of time can be obtained, thus it is possible to provide an image forming apparatus that has a stable image density and is capable of obtaining a high-quality color image with excellent color reproducibility and color balance can be provided.

Twenty-eighth means of the present invention is an image forming apparatus according to the twenty-fifth means, having: a first image forming station that is constituted by a first image forming unit group in which are arranged a plurality of image forming units each having at least an image supporting body and a development apparatus for developing an electrostatic latent image formed on the image supporting body, and a first intermediate transfer body for transferring and supporting a first toner image formed by the first image forming unit group; and a second image forming station that is constituted by a second image forming unit group in which are arranged a plurality of image forming units each having at least an image supporting body and a development apparatus for developing an electrostatic latent image formed on the image supporting body, and a second intermediate transfer body for transferring and supporting a second toner image formed by the second image forming unit group, wherein the first toner image to be transferred to a first surface of the recording material is formed by the first image forming station, the second toner image to be transferred to a second surface of the recording material is formed by the second image forming station, and the first toner image and the second toner image are transferred simultaneously or sequentially to the recording material before being fixed (so-called one-path both side transfer type). By using the development apparatus of any of the first through seventeenth means or of the twenty-third means as the development apparatus of each of the image forming units, the toner adhesion amount that is always stable for a long period of time can be obtained, thus it is possible to provide an image forming apparatus that has a stable image density and is capable of obtaining a high-quality color image with excellent color reproducibility and color balance can be provided. Moreover, by applying the development apparatus of the present invention to the image forming apparatus of one-path both side transfer type, a color image in which the density stability is excellent for a long period of time can be obtained at an extremely high productivity. Accordingly, a two-sided color image having the same stable image quality on both sides can be obtained.

Hereinafter, specific configurations, operations and effects of embodiments of the present invention are described in detail.

[Phase Control]

Figure 14:
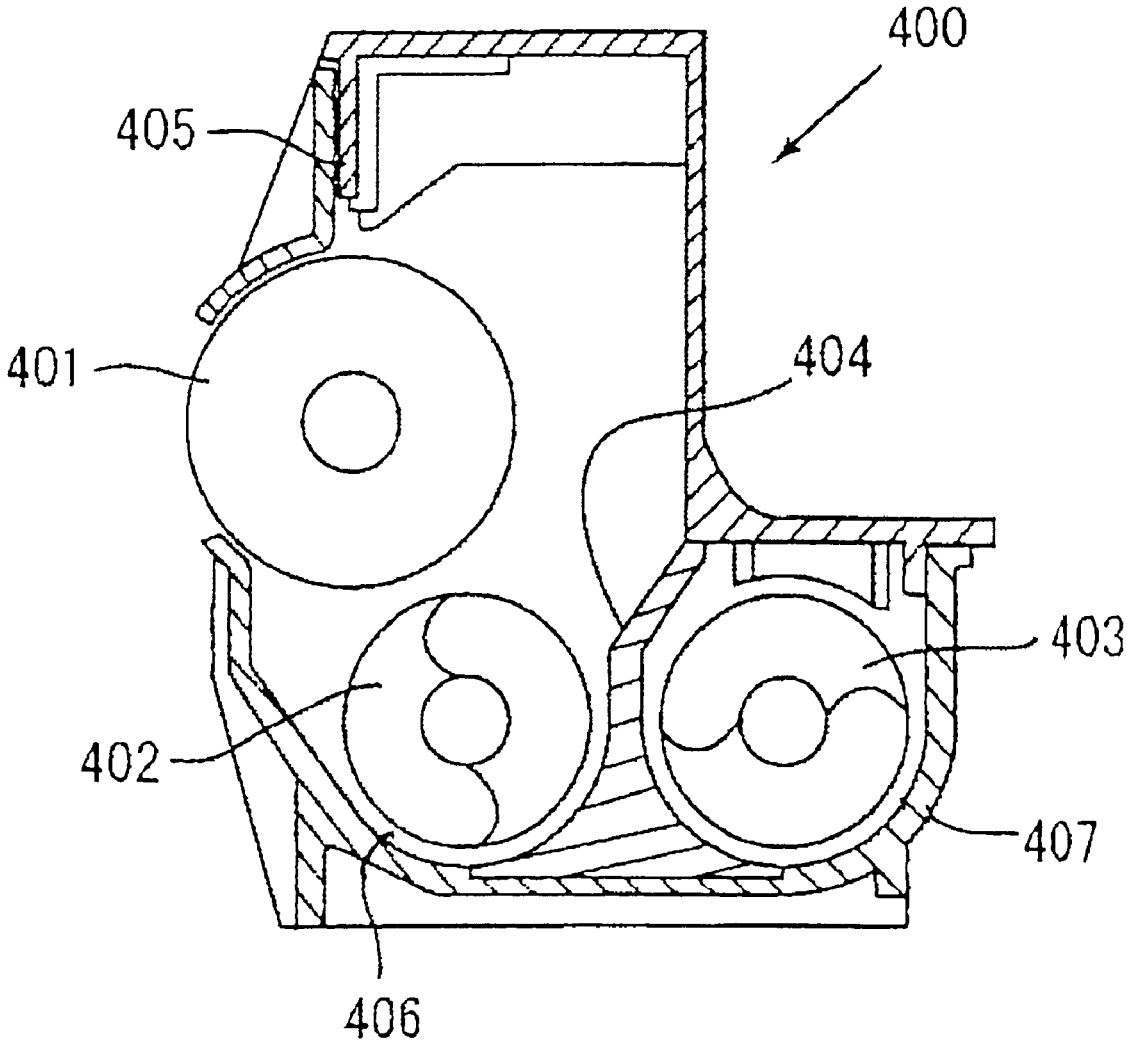
FIG. 14 is a cross-sectional view showing a schematic configuration of an example of a development apparatus of a biaxially-conveying type to which the present invention is applied.

An example of the development apparatus of biaxially-conveying type as shown in FIG. 14 is described.

In the development apparatus that uses a two-component developer composed of toner and carrier to replenish/consume the toner intermittently by means of two developer conveying members, toner density fluctuates periodically in longitudinal directions on the two developer conveying members respectively (e.g., a first screw 402, a second screw 403), as shown in FIG. 1.

A wavelength $\lambda$ indicating this fluctuation is determined by a toner replenishing cycle T1, a toner consuming cycle (image output cycle) T2, and conveying speed u of conveying the developer on the screws. A wavelength indicating a fluctuation caused by toner replenishment is expressed as $\lambda 1 = u \cdot T1$, and a wavelength indicating a fluctuation caused by toner consumption is expressed as $\lambda 2 = u \cdot T2$.

Although there are fluctuations indicated by the two different wavelengths, the amplitude of the fluctuation that is caused on the screws due to toner consumption is larger than the amplitude of the fluctuation that is caused on the screws due to toner replenishment, thus the wavelengths can be approximated to $\lambda \cong \lambda 1$.

Figure 2:
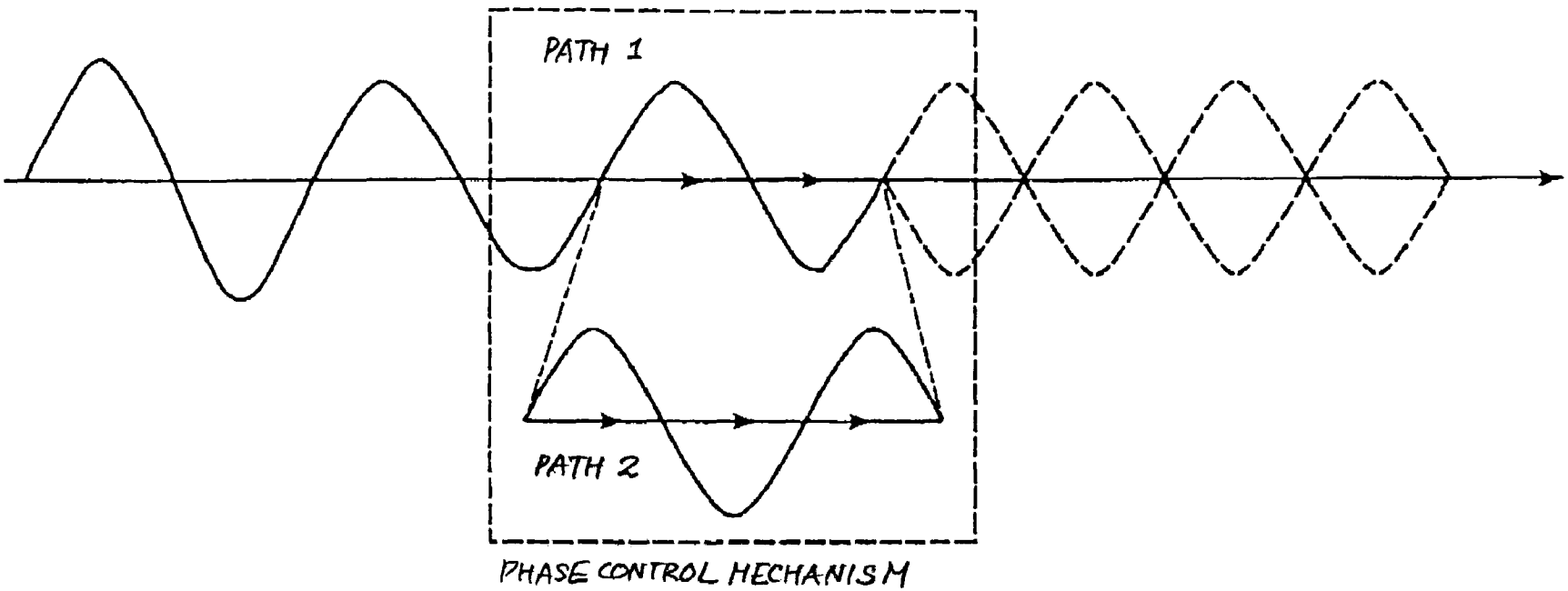
FIG. 2 is a figure for explaining a phase control method of the development apparatus according to the present invention.

FIG. 2 shows a state in which the loop of FIG. 1 is opened. The developer is divided into two parts in the middle of the loop, and the divided developer is caused to pass through a path 1 and a path 2 that have different lengths and then caused to merge with each other (called "phase control mechanism"), whereby the amplitude of the toner density fluctuations can be reduced. Particularly, the amount of developer passing through the path 1 and path 2 is divided exactly, the difference between the pats is taken as $\lambda/2$, and the phase is shifted by $\Pi$, whereby the amplitude of the fluctuation becomes logically 0.

[Opening Section of the Partition Plate]

Figure 3:
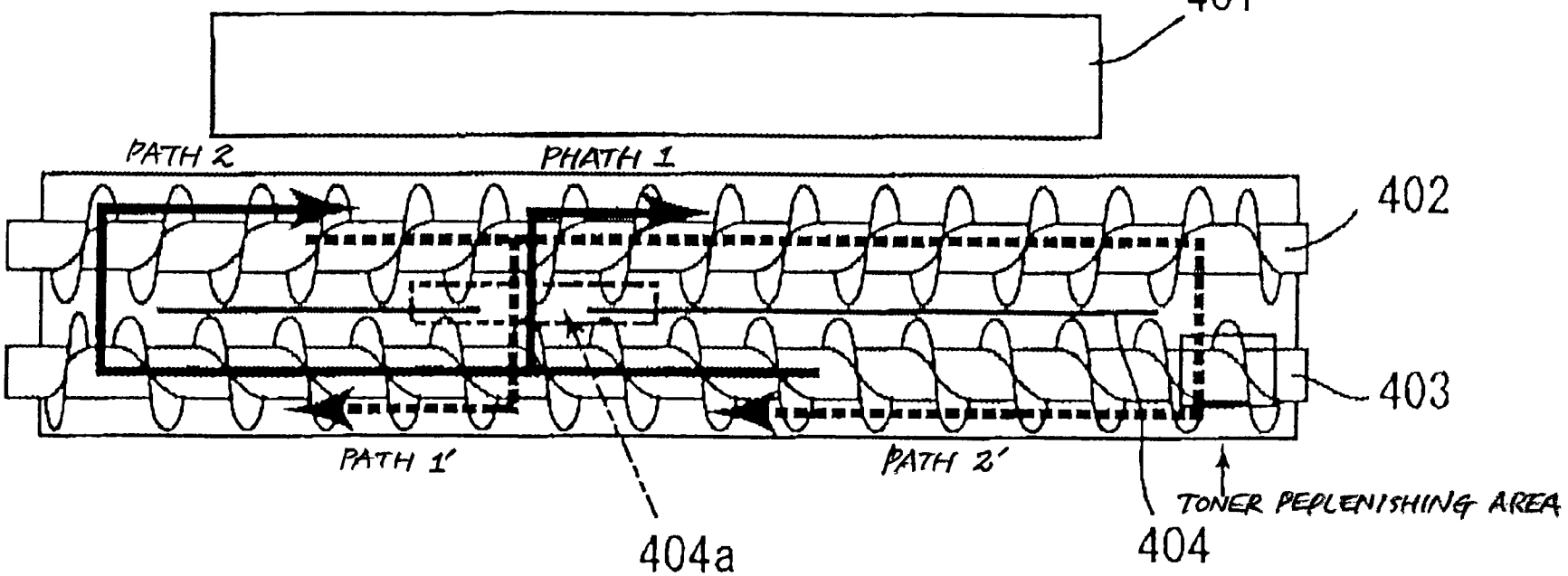
FIG. 3 is a figure for explaining an opening section of a partition plate in the development apparatus according to the present invention, and the phase control performed using the opening section.

One of the examples considered as the phase control mechanism is an opening section of a partition plate 404. By causing the developer to pass through the opening section 404*a* of the partition plate 404 as shown in FIG. 3, paths having different lengths can be obtained, whereby the phase can be shifted. By forming one opening section 404*a* on the partition plate 404, two phase control mechanisms of the different paths can be formed as shown by the solid arrow and dashed arrow.

Figure 4:
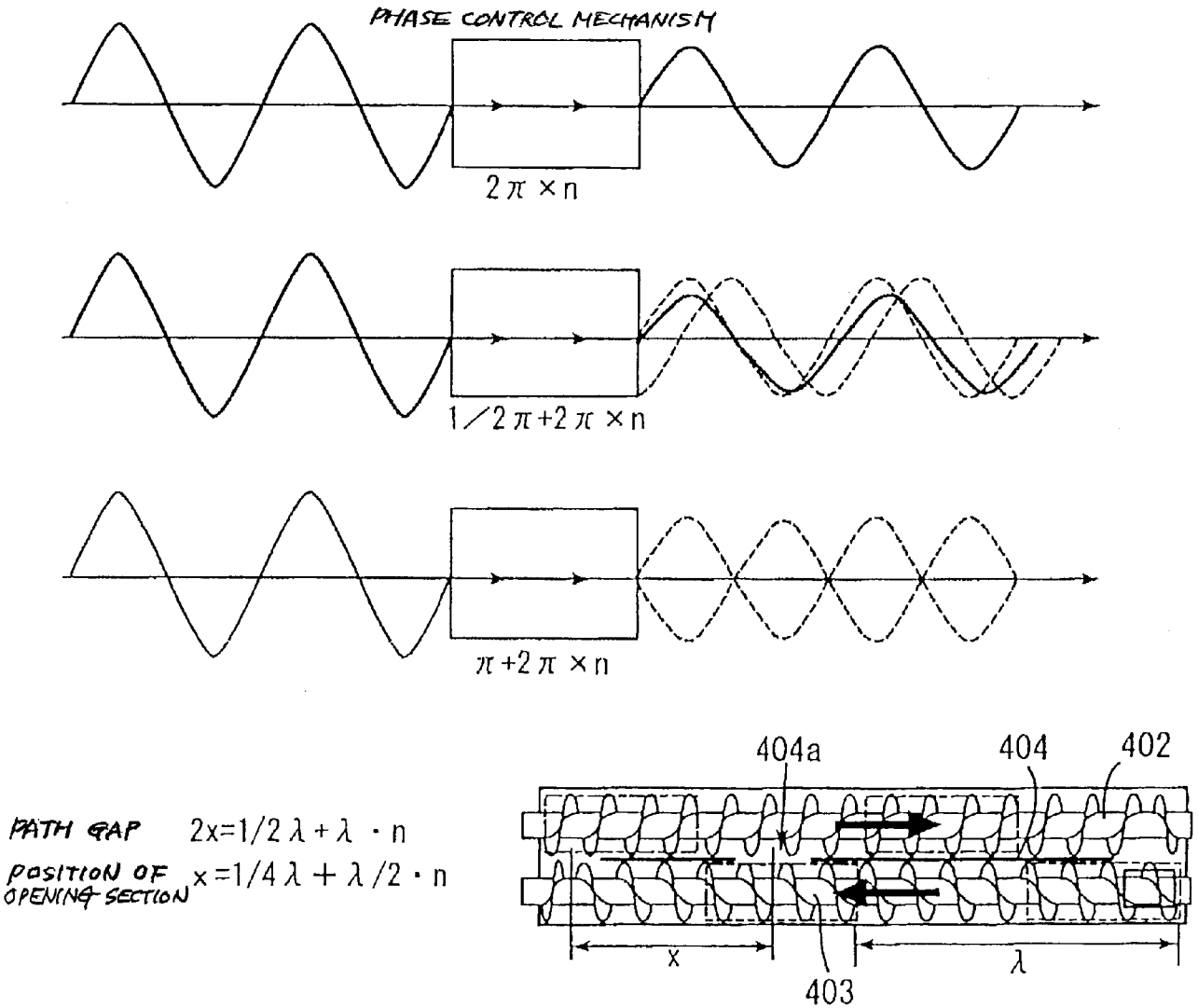
FIG. 4 is a figure for explaining a difference observed in effects of the phase control performed in accordance with the position of the opening section, when the position of the opening section of the partition plate shown in FIG. 3 is changed.

However, even if the opening section 404*a* is formed, effects cannot be obtained or extremely small effects are obtained according to location. Therefore, as shown in FIG. 4, it is the most effective to provide the opening section 404*a* on a position where the phase is shifted by $\Pi + 2\Pi \times n$. In order to do so, the opening section 404*a* may be preferably provided in the vicinity of the position of $\lambda/4 + \lambda/2 \cdot n$.

Figure 5:
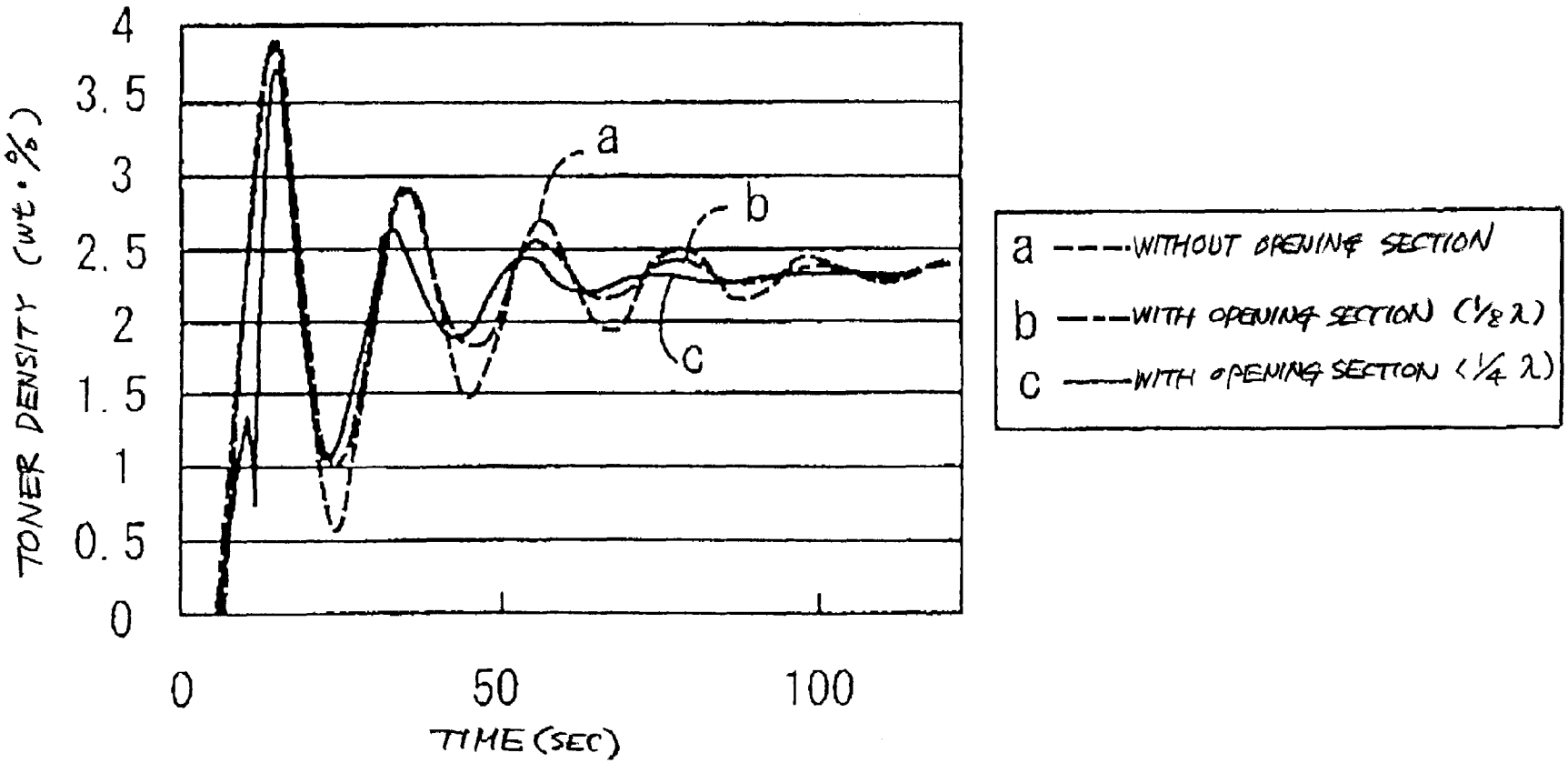
FIG. 5 is a graph showing the results of an experiment in which a time variation of the toner density fluctuation in a certain position on a screw is measured in the case in which a wavelength $\lambda$ indicating the toner density fluctuation is formed on the screw, the opening section is provided on the partition plate at the positions of $\lambda/8$ and $\lambda/4$, and a developer on the screw is circulated.

FIG. 5 shows the results of an experiment in which a time variation of the toner density fluctuation in a certain position on a screw is measured in the case in which the wavelength $\lambda$ indicating the toner density fluctuation is formed on the screw, the opening section 404*a* is provided on the partition plate 404 at the positions of $\lambda/8$ and $\lambda/4$, and the developer is circulated on the screw. It can be understood that a toner diffusion effect is high when the opening section is located in the position of $\lambda/4$.

However, when the developer conveying speed changes on the two screws holding the partition plate 404 therebetween (i.e., the first developer conveying member located proximate to a sleeve 401 is taken as the first screw 402, and a second developer conveying located distant from the sleeve 401 is taken as the second screw 403), the $\lambda$ also changes accordingly. If the conveying speed of conveying the developer on the first screw 402 is taken as $u_A$ and the conveying speed of conveying the developer on the second screw 403 is taken as $u_B$, wavelengths on the first screw 402 and the second screw 403 are $\lambda_A = u_A \cdot T2$ and $\lambda_B = u_B \cdot T2$ respectively. It should be noted that the λ described regarding the opening section of the partition plate is expressed as $\lambda = (\lambda_A + \lambda_B)/2$.

Figure 6A:
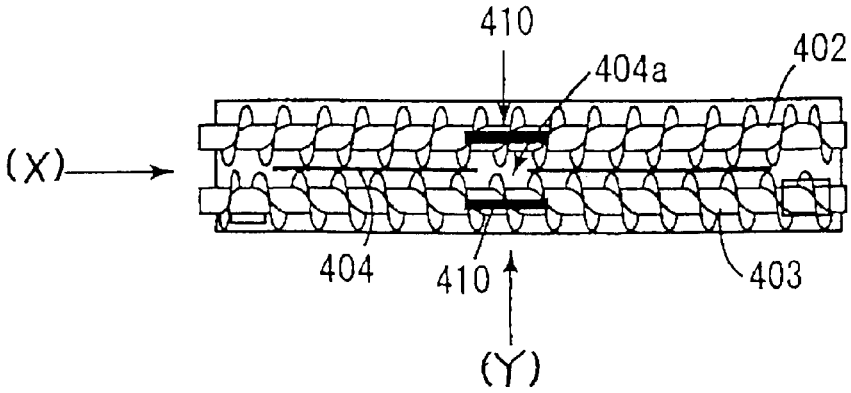
FIG. 6A is a figure showing attachment positions in which fins are attached to two developer conveying members (screws) of the development apparatus according to the present invention.
Figure 6B:
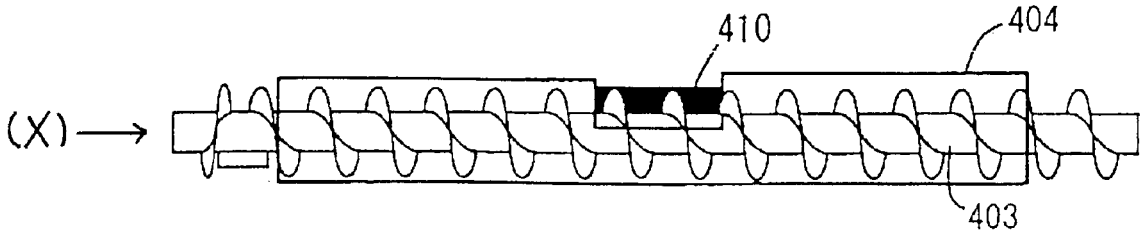
FIG. 6B is a figure viewed from an X direction shown in FIG. 6A.
Figure 6C:
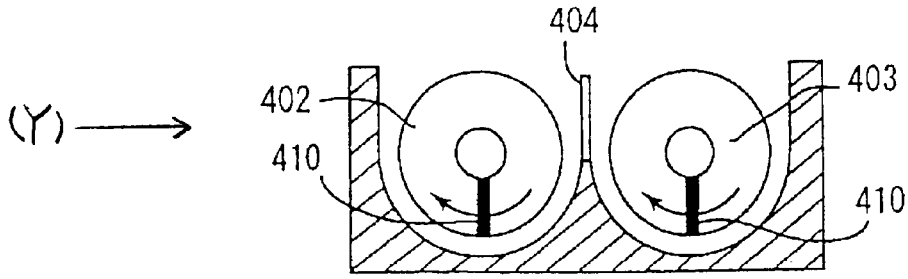
FIG. 6C is a figure viewed from a Y direction shown in FIG. 6A.

However, even if the opening section is provided, the amount of developer passing through the opening section is small. Therefore, as shown in FIGS. 6A through 6C, larger effects can be obtained by increasing the amount of developer passing through the opening section by attaching a fin 410 to the first screw 402 and the second screw 403. At this moment, the fin 410 attached to the first screw 402 and the fin 410 attached to the second screw 403 are parallel to each other so that even larger effects can be obtained.

Figure 7:
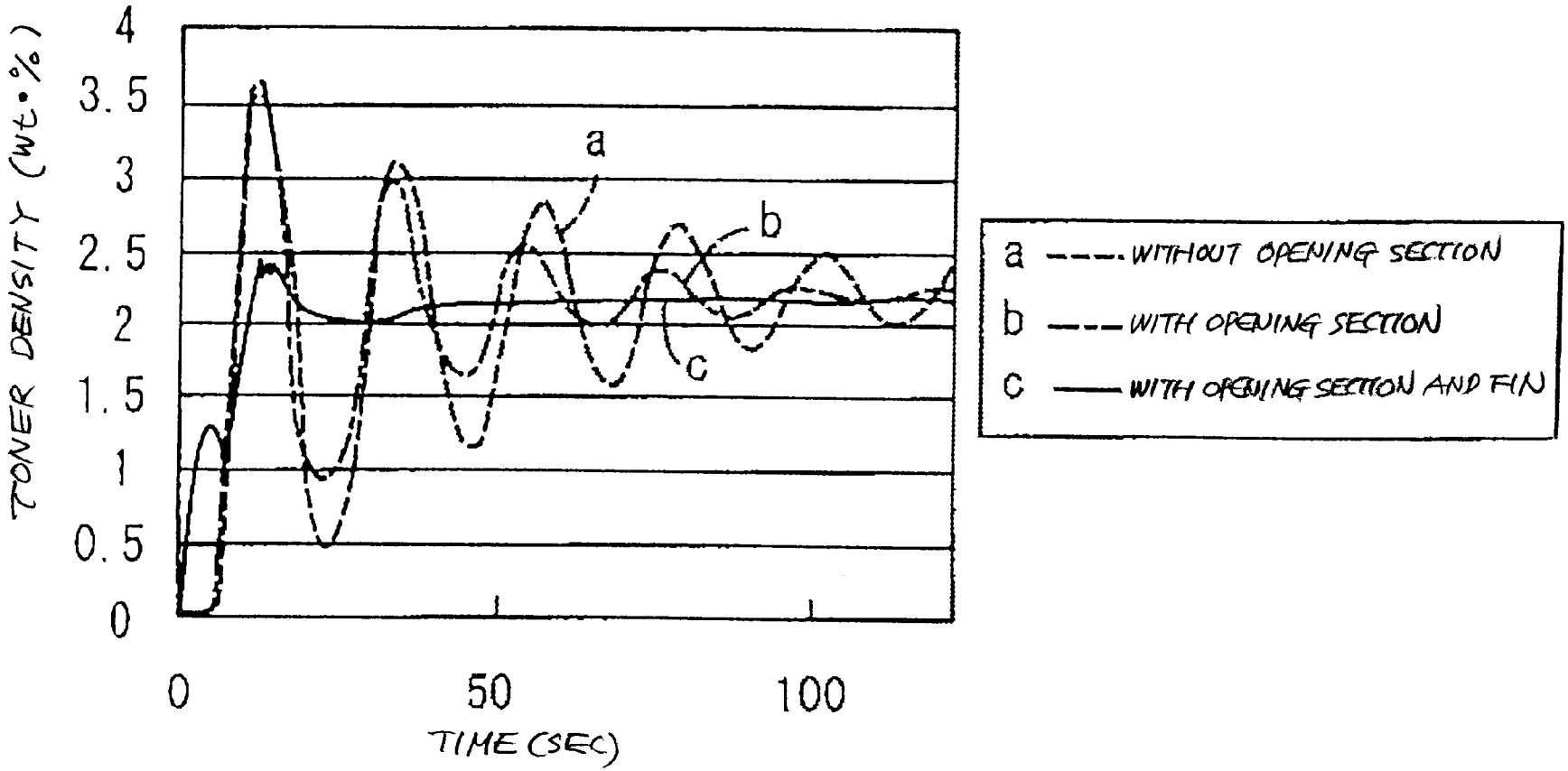
FIG. 7 is a graph showing the results of an experiment in which a time variation of the toner density fluctuation in a certain position on the screw is measured in the case in which the wavelength $\lambda$ indicating the toner density fluctuation is formed on the screw, the opening section is provided on the partition plate at the position of $\lambda/4$, and the developer on the screw is circulated.

FIG. 7 shows the results of an experiment in which a time variation of the toner density fluctuation in a certain position on the screw is measured in the case in which the wavelength λ indicating the toner density fluctuation is formed on the screw, the opening section is provided on the partition plate at the position of λ/4, and the developer is circulated on the screw. According to the results of the experiment, it is understood that larger toner diffusion effect can be obtained when the opening section is provided than when not provided, or when the fin is provided in addition to the opening section.

[Problems of Replenished Toner]

By providing the opening section on the partition plate as described above, there is a risk that sliding replenished toner may flow directly to the first screw 402 and then to the sleeve, but the following countermeasures can be considered for such risk.

Figure 8A:
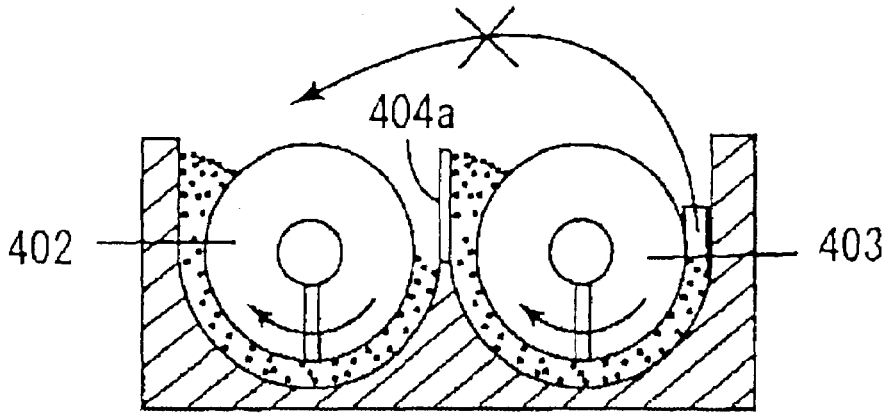
FIGS. 8A and 8B each shows a rotation direction of a second developer conveying member (screw B) of the development apparatus according to the present invention.
Figure 8B:
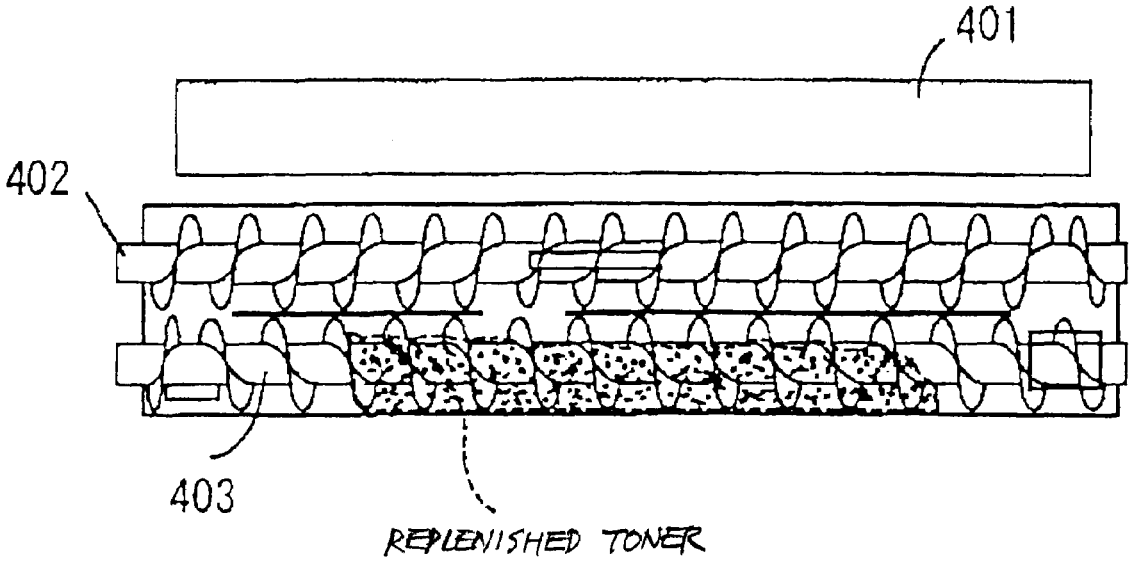

First, as shown in FIGS. 8A and 8B, the rotation direction of the second screw 403 is set to a direction in which the developer is drawn to the sleeve side. Consequently, even if the replenished toner slides, it is drawn to the side where the surface of the developer is low, i.e., the side opposite to the sleeve 401, whereby the sliding toner flows from the opening section 404*a* to the first screw 402 side.

Figure 9A:
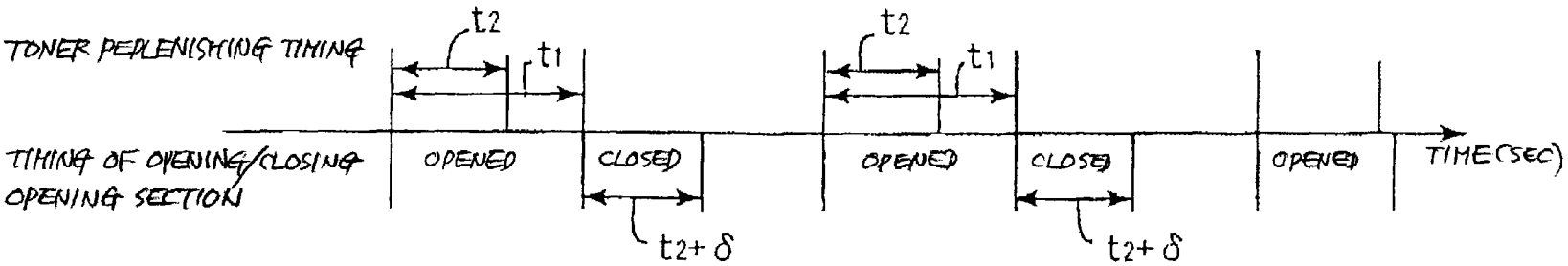
FIGS. 9A and 9B are figures for explaining an opening/closing mechanism provided on the opening section of the partition plate of the development apparatus according to the present invention, and opening/closing timing of the opening/closing mechanism.
Figure 9B:
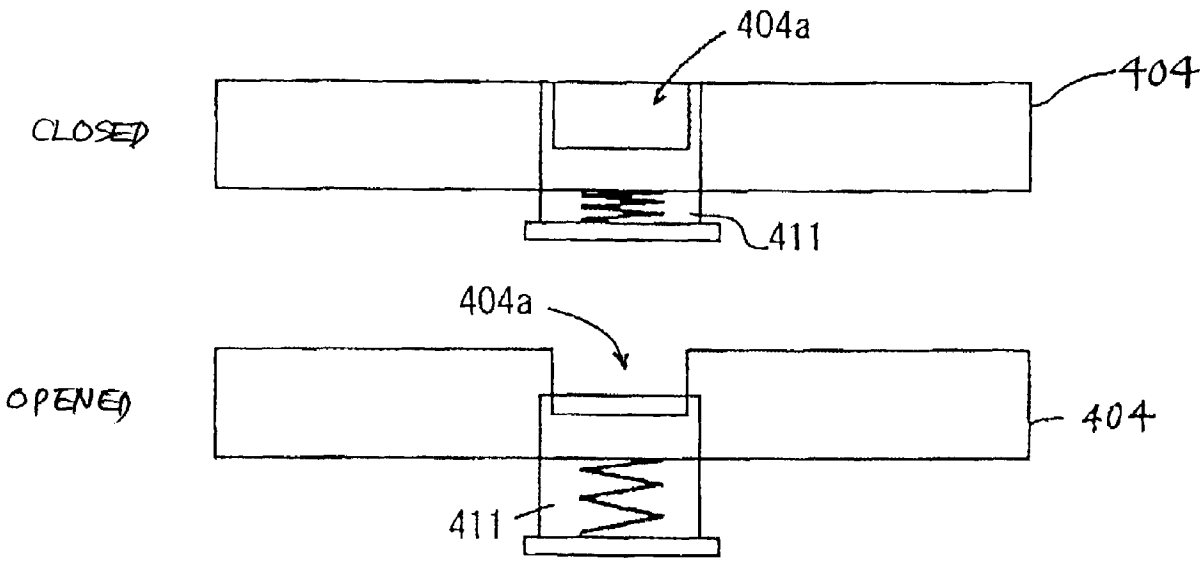

Secondly, an opening/closing mechanism 411 is provided as shown in FIG. 9B to control opening/closing of the opening section 404*a* of the partition plate 404, instead of constantly opening the opening section 404*a*. A time difference $t_1$ from the timing for starting replenishing the toner is provided, and thereafter the opening section 404*a* is closed for a time period of $t_2+\delta$ ($t_2$ is equal to the toner replenishing time). At this moment, on the basis of the developer conveying speed u of the screw, and the distance L in which the developer flows from a toner replenishing opening to the opening section, $t_1 = u \cdot L$ can be obtained. An example of the timing for opening and closing the toner is as shown in FIG. 9A. Also, the opening/closing mechanism of the opening section is, as shown in FIG. 9B, constituted by a plate-like shutter member, a spring, opening means (a solenoid, a cam mechanism, or the like) and the like.

[Developer End Opening Section]

Even without the opening section on the partition plate 404, the size of the opening sections provided on both ends of a conventional development apparatus can be adjusted, whereby the effect of shifting the phase can be obtained. Normally, the size of the opening section provided on each end section of the development apparatus is set to be approximately 1 through 1.5 times larger than the external diameter of the screw. Accordingly, almost no gap is obtained between the paths of the developer.

Figure 10:
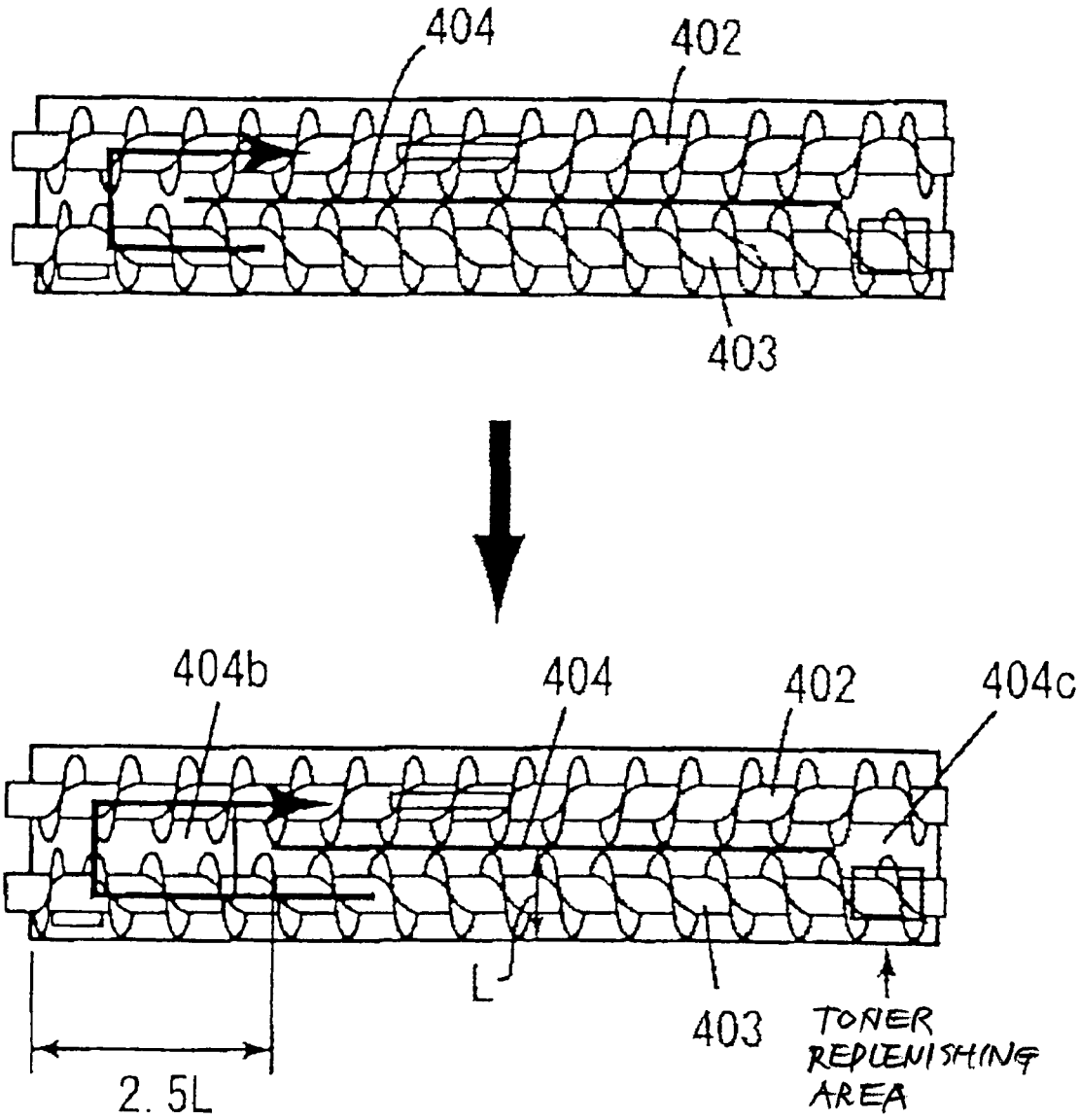
FIG. 10 is a figure for explaining a case in which the opening section on one end side of the partition plate is opened wide to perform phase control in the development apparatus according to the present invention.

Therefore, as shown in FIG. 10, the size of an opening section 404*b* provided on one end of the partition plate 404 is further increased to be at least twice the screw external diameter L (e.g., 2.5 L), thereby obtaining the gap between the paths of the developer. At this moment, an opening section 404*c* on an end in the vicinity of the toner replenishing position prevents the replenished toner from sliding, thus the size of this opening section is a conventional size.

[Developer Pool on the Sleeve]

Figure 11A:
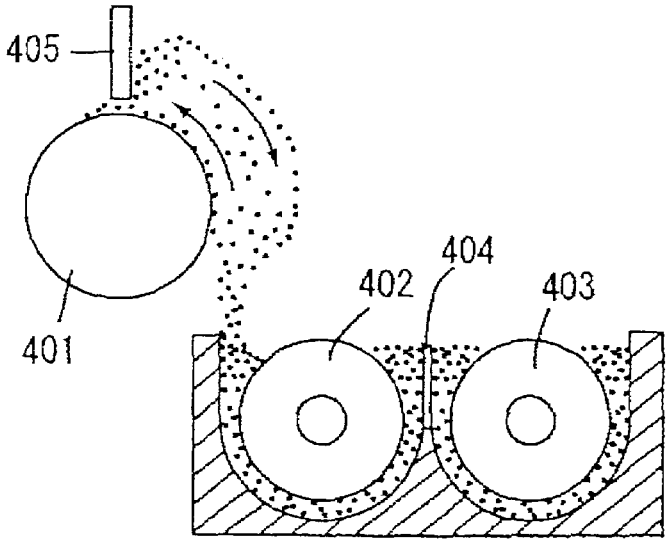
FIGS. 11A and 11B are figures for explaining a case in which a developer pool formed on a sleeve is used to perform the phase control in the development apparatus according to the present invention.

As shown in FIG. 11A, developer drawn up from the first screw 402 to the sleeve 401 does not all pass through a doctor 405 but is partially sent back to the first screw 402. Therefore, there is provided a function of creating two paths through which the developer flowing directly above the first screw 402 passes at an arbitrary point on the sleeve, and the developer drawn up from the first screw 402 to the sleeve 401 and sent back to the first screw 402 passes (phase control mechanism).

However, in order to allow a developer pool formed on the sleeve 401 to effectively function as the phase control mechanism, the amount of the developer passing through the path where the developer is drawn up to the sleeve 401 needs to be somewhat large.

The amount of developer Z that falls from the developer pool of the sleeve onto the first screw 402 before flowing from an upstream to a downstream of the first screw 402 is expressed as Z=X/u. Here, X[kg/s] is the amount per unit time of the developer falling from the developer pool of the sleeve onto the first screw 402, u[m/s] is the developer conveying speed of the first screw 402, and L is the length of an image area in the longitudinal direction of the sleeve. If this amount is at least substantially half the weight per unit length of the developer Y[kg/m] on the first screw 402, the effect of shifting the phase can be obtained.

Based on the above description, an equation of $X/u \geqq \frac{1}{2} Y$ is obtained. However, if the weight per unit length of the developer on the first screw 402 changes according to location, an average value of the weight per unit length of the developer in a longitudinal direction is expressed as a developer weight Y[kg/m].

Figure 12:
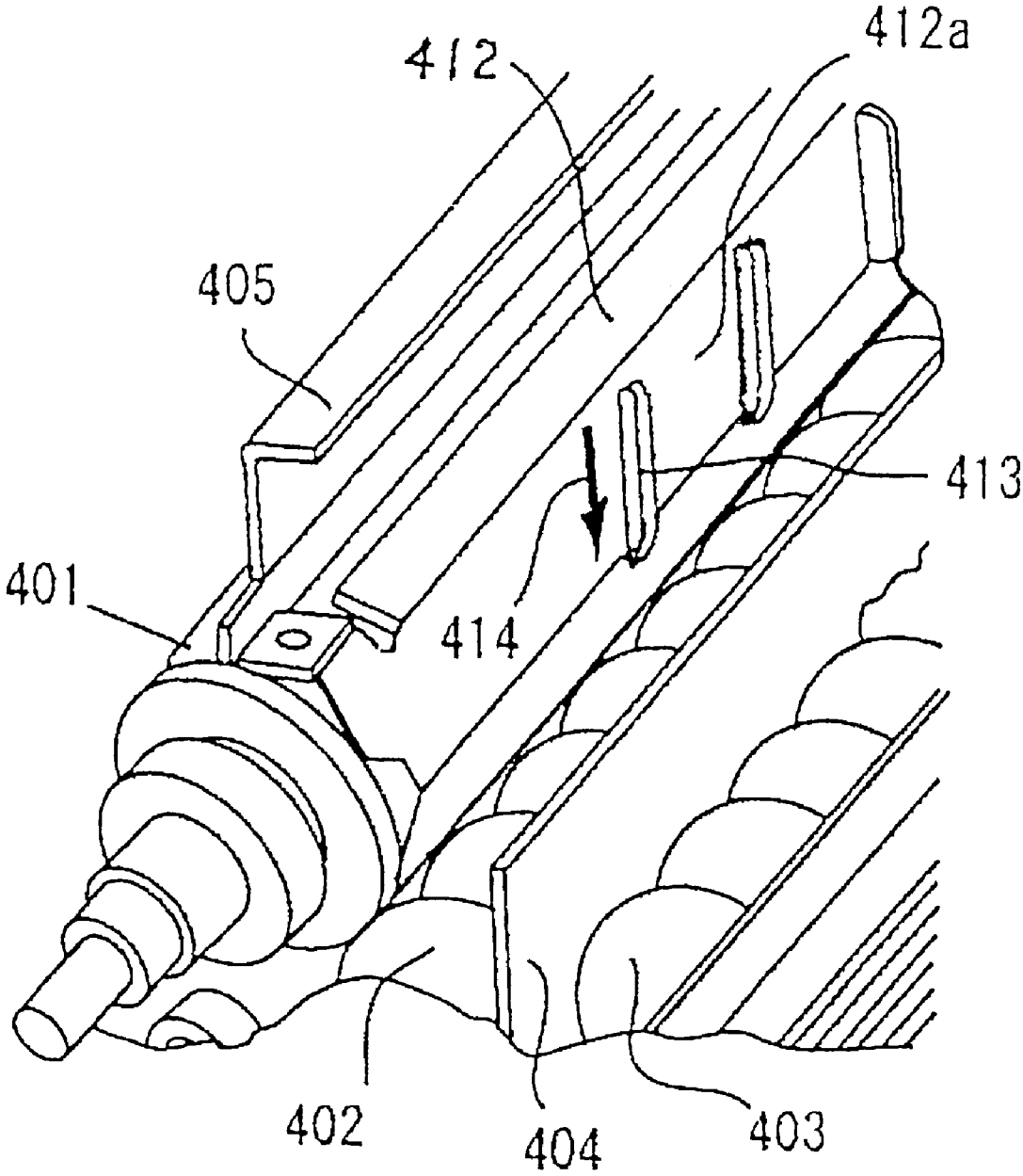
FIG. 12 is a perspective view showing a configuration in the vicinity of a doctor of the development apparatus according to the present invention.

Furthermore, in order to effectively shift the phase, the gap between the paths needs to be adjusted. FIG. 12 shows a configuration in the vicinity of the doctor of the development apparatus.

The thickness of the developer supplied from the first screw 402 to the sleeve 401 is regulated by the doctor 405, which is a developer regulating member, so as to be a fixed thickness that is suitable for development on the sleeve 401. The amount of the developer supplied to the sleeve 401 becomes at least the amount regulated by the doctor 405, thus the developer is gradually accumulated in front of the doctor 405. If the amount the developer becomes the fixed amount or more, the developer is spilt out onto an excess developer recovering member 412. A part of the spilt developer is guided to the upstream side in the conveying direction of the first screw 402 (direction of the arrow 414) by a guide (current plate) 413 provided on a wall surface 412*a* of the excess developer recovering member 412, and a part of the spilt developer falls directly onto the first screw 402.

Figure 11B:
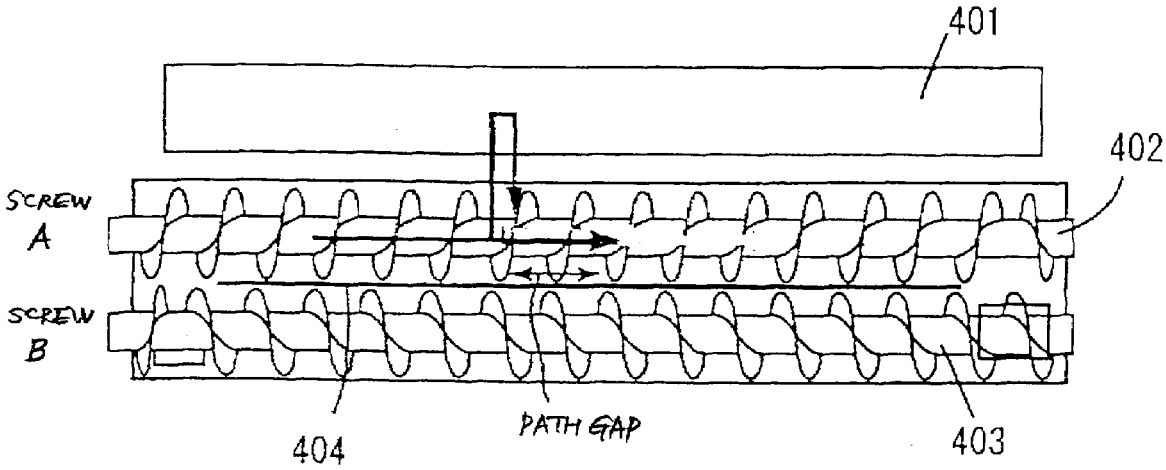
Figure 13:
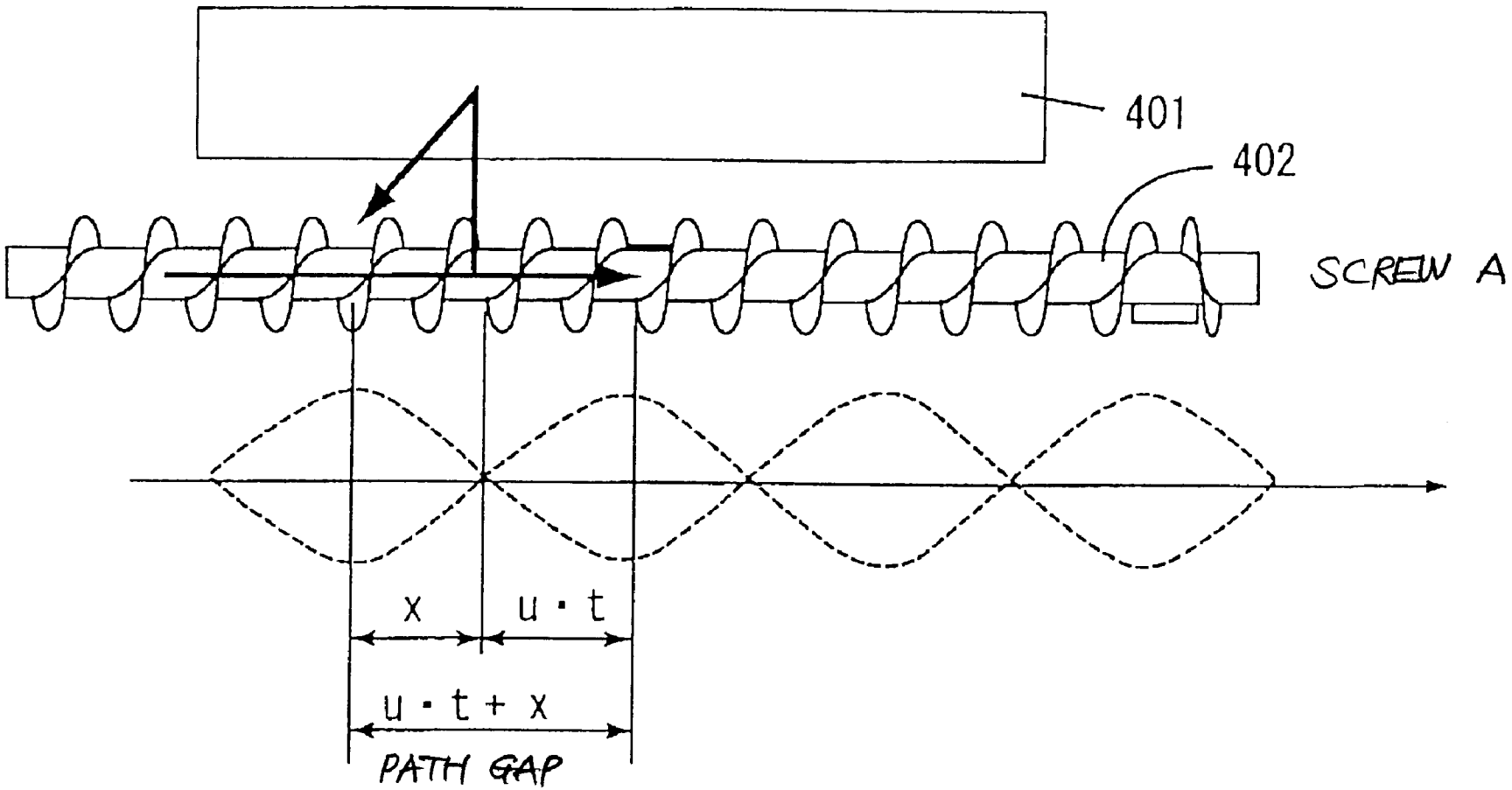
FIG. 13 is a figure for explaining a method of performing the phase control by using a gap between two paths for a developer flowing directly over a screw A and for a developer drawn up from the screw A to the sleeve and sent back to the screw A.

As shown in FIG. 12, by attaching the guide 413 to the developer pool section of the sleeve 401, the developer is not caused to fall vertically from the sleeve 401, but can be shifted toward the upstream side of the first screw 402 to fall. Accordingly, as shown in FIG. 13, the gap between the two paths through which the developer flowing directly over the first screw 402 passes and the developer that is drawn up from the first screw 402 to the sleeve 401 and sent back to the first screw 402 passes becomes large (comparison between FIG. 11 and FIG. 13). Further, in order to generate the effect of shifting the phase most, the inclination of the guide needs to be set so as to adjust the gap between the two paths to λ/2.

Therefore, the developer conveying speed of the first screw 402 is taken as u[m/s], the time in which the developer drawn up to the sleeve stays on the sleeve before falling onto the first screw 402 is taken as t[s], and a shift distance in which the developer is guided to the upstream side by the guide is taken as x[m], to adjust the shift distance x. The inclination of the guide may be set so that the shift distance x becomes $u \cdot t + x$ (path gap)$=\lambda/2$.

[Configuration Example of the Development Apparatus]

Figure 15:
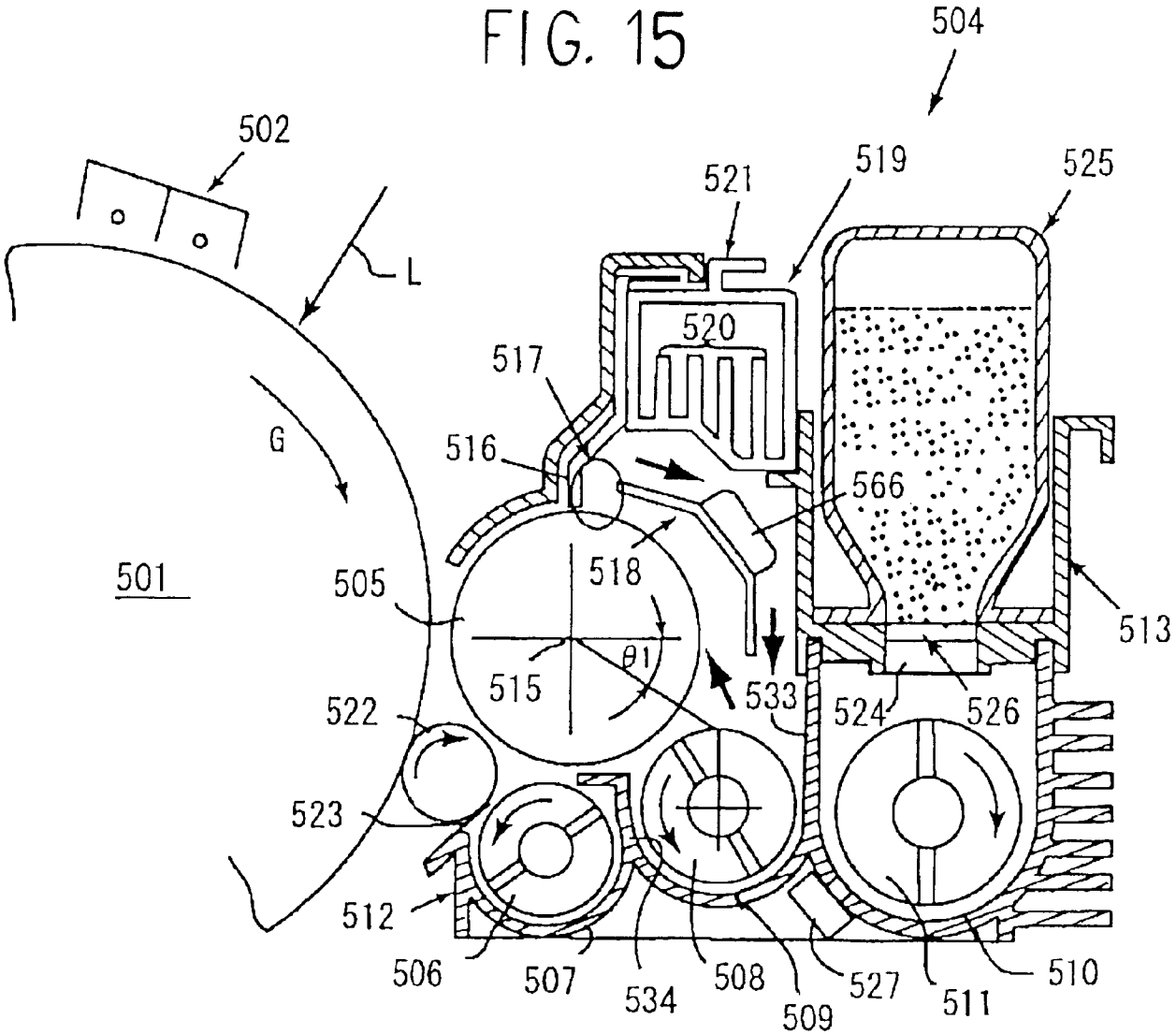
FIG. 15 is a cross-sectional view showing a schematic configuration of an example of a development apparatus of a triaxially-conveying type to which the present invention is applied.
Figure 16:
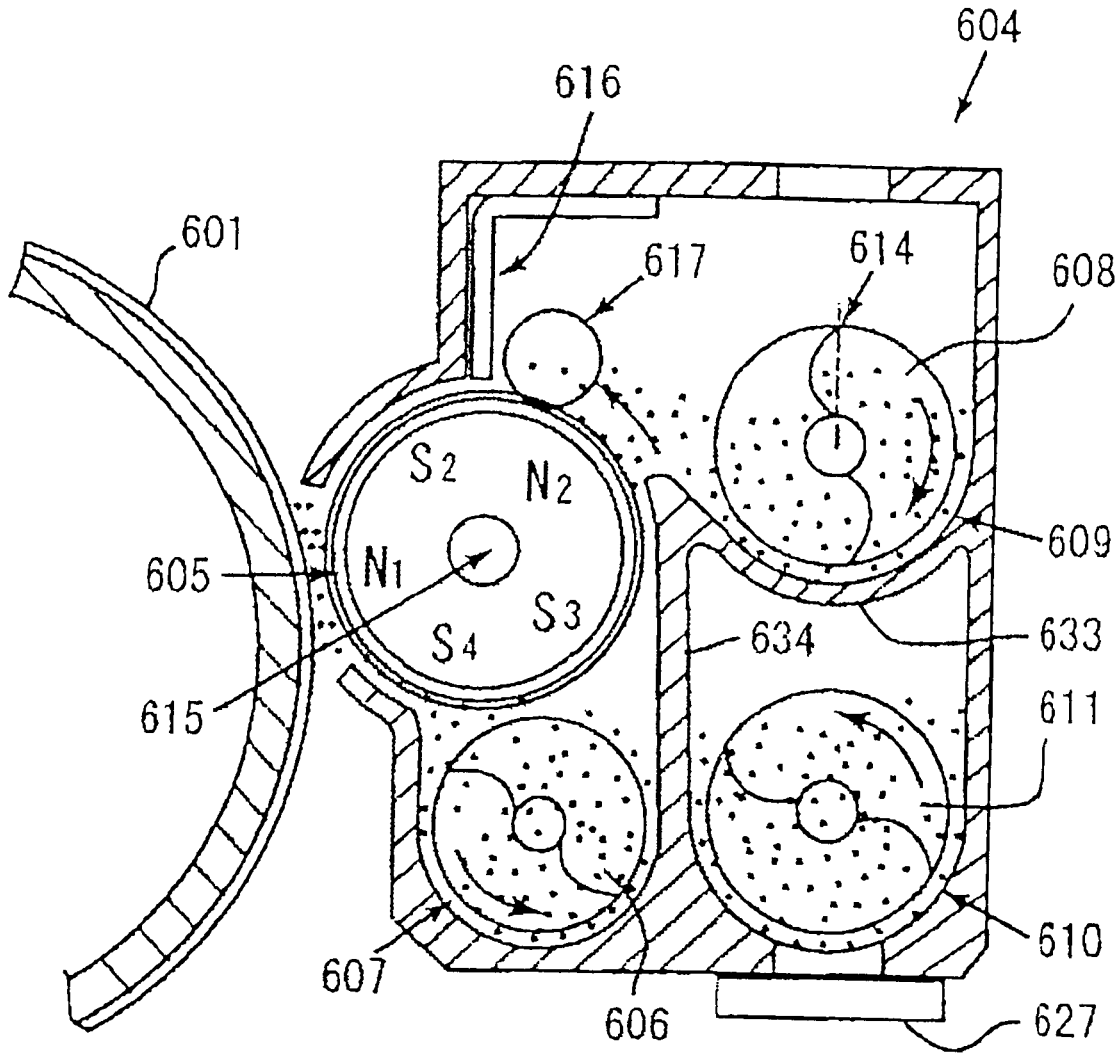
FIG. 16 is a cross-sectional view showing a schematic configuration of another example of the development apparatus of a triaxially-conveying type to which the present invention is applied.

The phase control mechanism of the present invention described above can be suitably applied to a development apparatus of biaxially-conveying type, as shown in FIG. 14. The phase control mechanism can also be applied to a development apparatus of triaxially-conveying type as shown in FIG. 15 and FIG. 16.

A development apparatus 400 shown in FIG. 14 has the developing roller (sleeve) 401, which is a developer supporting body for supplying developer to an unshown image supporting body (the developing roller is constituted by a cylindrical sleeve that rotates, and a magnet or magnetic roll disposed fixedly in the sleeve, but the figure shows a sleeve only), the developer regulating member (doctor) 405 that regulates the amount of developer on the sleeve, and a supplying/recovering screw 402 (the first screw 402 described above), which is a first developer conveying member that conveys and supplies the developer to the developing roller 401 and recovers the developer from the developing roller 401.

The development apparatus 400 further has a stirring/conveying screw 403 (the second screw 403 described above), which is a second developer conveying member that stirs and conveys, in a direction opposite to the direction of the supplying/recovering screw 402, the developer conveyed to the end of the downstream of the supplying/recovering screw 402 and toner supplied according to need. The supplying/recovering screw 402 and the stirring/conveying screw 403 are disposed in a horizontal direction, and a supplying/recovering conveying path 406 having the supplying/recovering screw 402 and a stirring/conveying path 407 having the stirring/conveying screw 403 are partitioned by the partition plate 404. The two conveying paths are communicated with each other via the opening section provided on each end of the axial direction of the partition plate 404, and the developer is conveyed in the opposite direction by the stirring/conveying path 407 and the supplying/recovering conveying path 406, whereby the developer is circulated and conveyed.

In the development apparatus of biaxially-conveying type that is configured as described above, the developer obtained after development is recovered by the supplying/recovering screw 402, thus the toner density decreases as the developer flows to the downstream of the screw 402, causing a toner density fluctuation between the right and left sides of the sleeve of the developing roller 401.

Therefore, the development apparatus 400 of biaxially-conveying type that is configured as shown in FIG. 14 is provided with the phase control opening or mechanism related of the present invention described with reference to FIG. 1 through FIG. 13, whereby a toner density fluctuation can be prevented from occurring. Specifically, the phase control opening or mechanism is provided in which a dividing point is intentionally formed in the flow of the developer, thus obtained divided developers are caused to pass through different paths, whereby a phase of the toner density fluctuation in the developer is shifted, and thereafter the developers with shifted phases are caused to merge with each other again. By applying such configuration to the development apparatus, the developer having a high toner density flows to the supplying/recovering screw 402, whereby the toner density fluctuation between the right and left sides of the sleeve can be reduced. Therefore, fluctuation of the toner density and variation of a toner charge amount can be prevented from occurring before the developer is drawn up to the sleeve of the developing roller 401, and a toner image can be formed stably.

Next, a development apparatus 504 shown in FIG. 15 has a developing roller (constituted by a cylindrical sleeve that rotates, and a magnet or magnetic roll that is fixedly disposed in the sleeve) 505, which is the developer supporting body that moves on the surface in a counterclockwise direction and supplies toner to a latent image formed on the surface of a photosensitive drum 501, which is a latent image supporting body, to perform development. The development apparatus 504 further has a supplying/conveying screw 508 (same as the first screw 402 described above), which is a developer supplying/conveying member that conveys the developer to the far side of FIG. 15 while supplying the developer to the developing roller 505.

on a downstream side in a surface movement direction from a section where the developing roller 505 faces the supplying/conveying screw 508, there is provided a doctor 516, which is the developer regulating member that regulates the thickness of the developer supplied to the developing roller 505 so as to be the thickness suitable for performing development.

On a downstream side in a surface movement direction from a development section, which is a section where the developing roller 505 faces the photosensitive drum 501, there is provided a recovering/conveying screw 506 that recovers the developed developer that has passed through the development section, and conveys the recovered developer in the same direction as the supplying/conveying screw 508. A supplying/conveying path 509, which is a developer supplying/conveying path having the supplying/conveying screw 508, and a recovering/conveying path 507, which is a developer recovering/conveying path having the recovering/conveying screw 506 are disposed in parallel with each other in a lower part of the developing roller 505. The two conveying paths, the supplying/conveying path 509 and the recovering/conveying path 507, are partitioned by a partition plate 534, which is a partition member.

The development apparatus 504 is provided with a stirring/conveying path 510, which is a developer stirring/conveying path disposed in parallel with the opposite side of the recovering/conveying path 507 of the supplying/conveying path 509. The stirring/conveying path 510 has a stirring/conveying screw 511 (same as the second screw 403 described above), which is a developer stirring/conveying member that stirs and conveys the developer to the front side of the figure, which is a direction opposite to that of the supplying/conveying screw 508. The supplying/conveying path 509 and the stirring/conveying path 510 are partitioned by a partition plate 533, which is a partition member. The front side and far side of the partition plate 533 in the figure form opening sections through which the supplying/conveying path 509 and the stirring/conveying path 510 are communicated with each other. Excess developer, which is supplied into the supplying/conveying path 509 and conveyed to the end of a downstream of a conveying direction of the supplying/conveying path 509 without being used for development, and recovered developer, which is conveyed to the end of a downstream of the conveying direction of the recovering/conveying path 507 by the recovering/conveying screw 506, are supplied to the stirring/conveying path 510. The stirring/conveying path 510 stirs the supplied excess developer and recovered developer, and conveys them to an upstream of a conveying direction of the supplying/conveying screw 508, which is a downstream of a conveying direction of the stirring/conveying screw 511.

An end in a far direction of the figure, which is a downstream of a conveying direction of the recovering/conveying screw 506, is an opening section formed on the partition plate 534, and the supplying/conveying path 509 an the recovering/conveying path 507 are communicated with each other via this opening section. Three conveying paths are communicated with one another at a downstream end of the conveying direction of the recovering/conveying screw 506, a downstream end of the conveying direction of the supplying/conveying screw 508, and an upstream end of the conveying direction of the stirring/conveying screw 511.

The recovered developer conveyed to the downstream end of the conveying direction of the recovering/conveying path 507 is sent to the supplying/conveying path 509. Also, the recovered developer and the developer that is conveyed by the supplying/conveying screw 508 but is not supplied to the developing roller 505 are delivered to the stirring/conveying path 510 communicated therewith.

In the stirring/conveying path 510, the stirring/conveying screw 511 stirs and conveys the recovered developer, excess developer, and the toner that is replenished by a delivering section if necessary, in a direction opposite to the direction of the developers of the recovering/conveying path 507 and supplying/conveying path 509. Then, the stirred developer is delivered to the upstream side of the conveying direction of the supplying/conveying path 509 communicated with the stirring/conveying path 510 at the downstream side of the conveying direction. It should be noted that a toner density sensor 527 is provided in a lower part of the stirring/conveying path 510, and the toner is replenished to the delivering section by a toner replenishment control device (not shown) by means of a sensor output.

A casing of the development apparatus 504 is constituted by a lower casing 512 and an upper casing 513 that are integrally molded and divided into a lower part and an upper part at the axis sections of the three conveying screws. The partition plate 533 is a part of the lower casing 512, while the partition plate 534 is held by the upper casing 513 and joined with the lower casing 512.

As shown in FIG. 15, an apex 514 of the supplying/conveying screw 508, which is also an uppermost part of the developer supplying member, is disposed so as to be lower than a rotation center 515 of the developing roller 505. In the development apparatus 504 shown in FIG. 15, an angle $\theta_1$ between a straight line connecting the rotation center 515 of the developing roller 505 with a screw apex 514 and a horizontal straight line passing through the rotation center 515 is set to 30°. This angle $\theta_1$ varies according to the diameter of the supplying/conveying screw 508, but is preferably 10° through 40° from the aspect of the layout in order to reduce the size of the development apparatus 504.

The magnetic poles of the magnet or magnetic roll provided within the developing roller 505 supply the developer to the sleeve of the developing roller 505 by attracting magnetic carrier inside the developer. As described above, by placing the screw apex 514 to be lower than the rotation center 515 of the developing roller 505, the self-weight of the developer does not affect the amount of developer to be supplied to the developing roller 505, and the magnitude of the magnetic force contributes to the supplied amount of the developer. Accordingly, the developer is securely supplied from the upper part of the developer by the supplying/conveying path 509. Therefore, even if the bulk of the developer within the supplying/conveying path 509 is not even in the conveying direction of the supplying/conveying screw 508, an appropriate amount of developer can be supplied to the developing roller 505.

In the development apparatus 504 of triaxially-conveying type that is configured as described above, the developer drawn up to the sleeve of the developing roller 505 is collected to the recovering/conveying screw 506, but is not sent back directly to the supplying/conveying screw 508, thus the amount of the developer decreases as the developer flows to the downstream of the supplying/conveying screw, whereby there is a risk that the developer runs dry in the downstream section. In order to prevent such depletion, it is necessary to increase the number of rotations of the screws, but there is a limit to such idea when considering the life of the axle bearing.

Therefore, the development apparatus of triaxially-conveying type that is configured as shown in FIG. 15 is provided with the phase control opening or mechanism of the present invention that is described with reference to FIG. 1 through FIG. 13, whereby the toner density is prevented from fluctuating, and it becomes extremely advantageous in preventing the developer from drying out. Specifically, the phase control opening or mechanism is provided, a dividing point is intentionally formed in the flow of the developer, thus obtained divided developers are caused to pass through different paths, and the developer is supplied from the stirring/conveying path 510 to the supplying/conveying screw 508, whereby the toner density fluctuation between the right and left sides of the sleeve, and fluctuation of the developer amount can be reduced.

Therefore, fluctuation of the toner density and variation of a toner charge amount can be prevented from occurring before the developer is drawn up to the sleeve of a developing roller 505, and the developer can be prevented from drying out in the downstream section, whereby a toner image can be formed stably.

Next, a development apparatus 604 shown in FIG. 16 has the developing roller (constituted by a cylindrical sleeve that rotates, and a magnet or magnetic roll that is fixedly disposed in the sleeve) 605, a supplying/conveying screw 608 (same as the first screw 402 described above), and a recovering/conveying screw 606 that conveys, in the same direction as the supplying/conveying screw 608, the developer that passes through a development section on the developing roller 605 and is recovered. The development apparatus 604 further has a stirring/conveying screw 611 (same as the second screw 403 described above) that stirs and conveys excess developer conveyed to the lowermost stream side of the supplying/conveying screw 608 and the recovered developer conveyed to the lowermost stream section of the recovering/conveying screw 606, in a direction opposite to the direction of the supplying/conveying screw 608.

The supplying/conveying screw 608 is disposed above the stirring/conveying screw 611, and a supplying/conveying path 609 having the supplying/conveying screw 608 and a stirring/conveying path 610 having the stirring/conveying screw 611 are partitioned by a first partition plate 633, which is a partition member. The two conveying paths are communicated with each other via opening sections formed on both ends of the axial direction of the first partition plate 633. The excess developer that is conveyed to the end of a downstream of the supplying/conveying path 609 without being used for development falls at the opening section on the downstream end side of the supplying/conveying path 609, and is supplied to the stirring/conveying path 610.

Furthermore, a recovering/conveying path 607 having the recovering/conveying screw 606 is arranged in parallel with the horizontal direction of the stirring/conveying path 610, and the recovering/conveying path 607 and the stirring/conveying path 610 are partitioned by a second partition plate 634, which is a partition member. These two conveying paths are communicated with each other via an opening section that is provided on the second partition plate 634 on a downstream end side of the recovering/conveying screw 606. The recovered developer conveyed to the end of a downstream of the recovering/conveying path 607 is delivered in the horizontal direction and supplied to the stirring/conveying path 610.

The excess developer and recovered developer that are supplied to the stirring/conveying path 610 are stirred at the stirring/conveying path 610, pushed and risen at the downstream end by a conveying force of the stirring/conveying screw 611, and thereby supplied from the opening section to the supplying/conveying path 609.

In the development apparatus of triaxially-conveying type that is configured as described above, the developer drawn up to the sleeve of the developing roller 605 is collected to the recovering/conveying screw 606, but is not sent back directly to the supplying/conveying screw 608, thus the amount of the developer decreases as the developer flows to the downstream of the supplying/conveying screw, whereby there is a risk that the developer runs dry in the downstream section. In order to prevent such depletion, it is necessary to increase the number of rotations of the screws, but there is a limit to such idea when considering the life of the axle bearing.

Therefore, the development apparatus of triaxially-conveying type that is configured as shown in FIG. 16 is provided with the phase control opening or mechanism of the present invention that is described with reference to FIG. 1 through FIG. 13, whereby the toner density is prevented from fluctuating, and it becomes extremely advantageous in preventing the developer from drying out. Specifically, the phase control opening or mechanism is provided, a dividing point is intentionally formed in the flow of the developer, thus obtained divided developers are caused to pass through different paths, and the developer is supplied from the stirring/conveying path 610 to the supplying/conveying screw 608, whereby the toner density fluctuation between the right and left sides of the sleeve, and fluctuation of the developer amount can be reduced.

Therefore, fluctuation of the toner density and variation of a toner charge amount can be prevented from occurring before the developer is drawn up to the sleeve of a developing roller 605, and the developer can be prevented from drying out in the downstream section, whereby a toner image can be formed stably.

[Entire Configuration of the Image Forming Apparatus]

Figure 17:
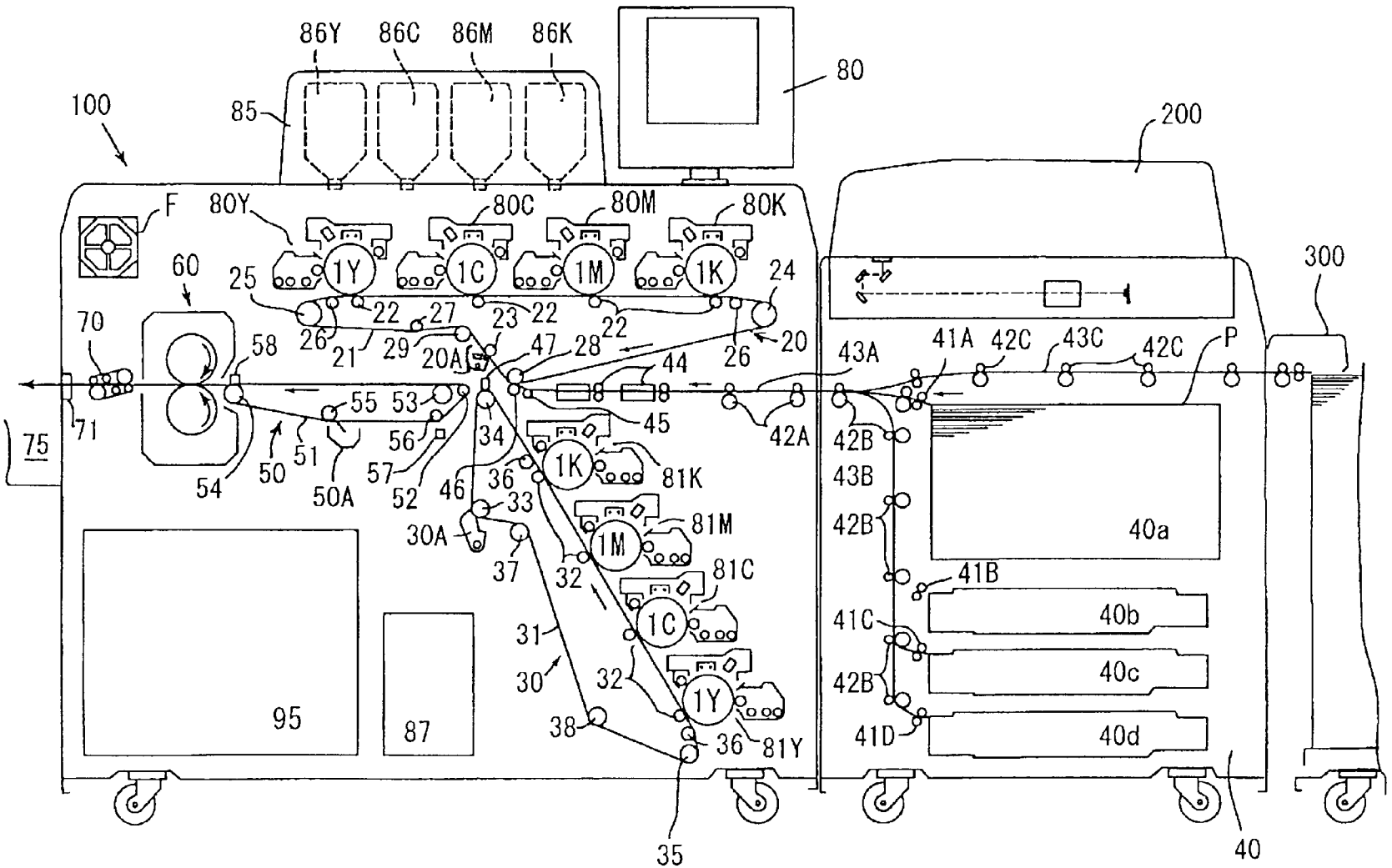
FIG. 17 is a cross-sectional view showing an internal configuration of an embodiment of an image forming apparatus to which the present invention is applied.

Next, a configuration example of the image forming apparatus according to the present invention is described in detail. FIG. 17 shows an internal configuration of the entire image forming apparatus to which the present invention is applied.

The inside of an image forming apparatus main body 100 shown in FIG. 17 is provided with upper and lower image forming stations having a recording body conveying path 43A therebetween. The first image forming station in the upper part is disposed with a first image supporting body unit 20 having a first image supporting belt 21 which is a first intermediate transfer body moving endlessly in a direction of the arrow, while the second image forming station in the lower part is disposed with a second image supporting body unit 30 having a second image supporting belt 31 which is a second intermediate transfer body moving endlessly in a direction of the arrow.

An upper extending surface of the first image supporting belt 21 is disposed with a first image forming unit group (four first image forming units 80Y, 80C, 80M and 80K), and an inclined extending surface of the second image supporting belt 31 is disposed with a second image forming unit group (four second image forming units 81Y, 81C, 81M and 81K).

Y, C, M and K that are added to the numbers of these first and second image forming units correspond to the colors of toners, thus Y means yellow, C means cyan, M means magenta, and K means black. For the same reason, Y, C, M and K are added to respective photoconductors 1 (latent image supporting bodies) that are respectively provided in the first and second image forming units and rotated along with the first image supporting belt 21 and the second image supporting belt 31.

It should be noted that the photoconductors 1Y through 1K are disposed at regular intervals and brought into contact with a part of an extending section of the first and second image supporting belts 21, 31 at least when an image is formed.

Figure 18:
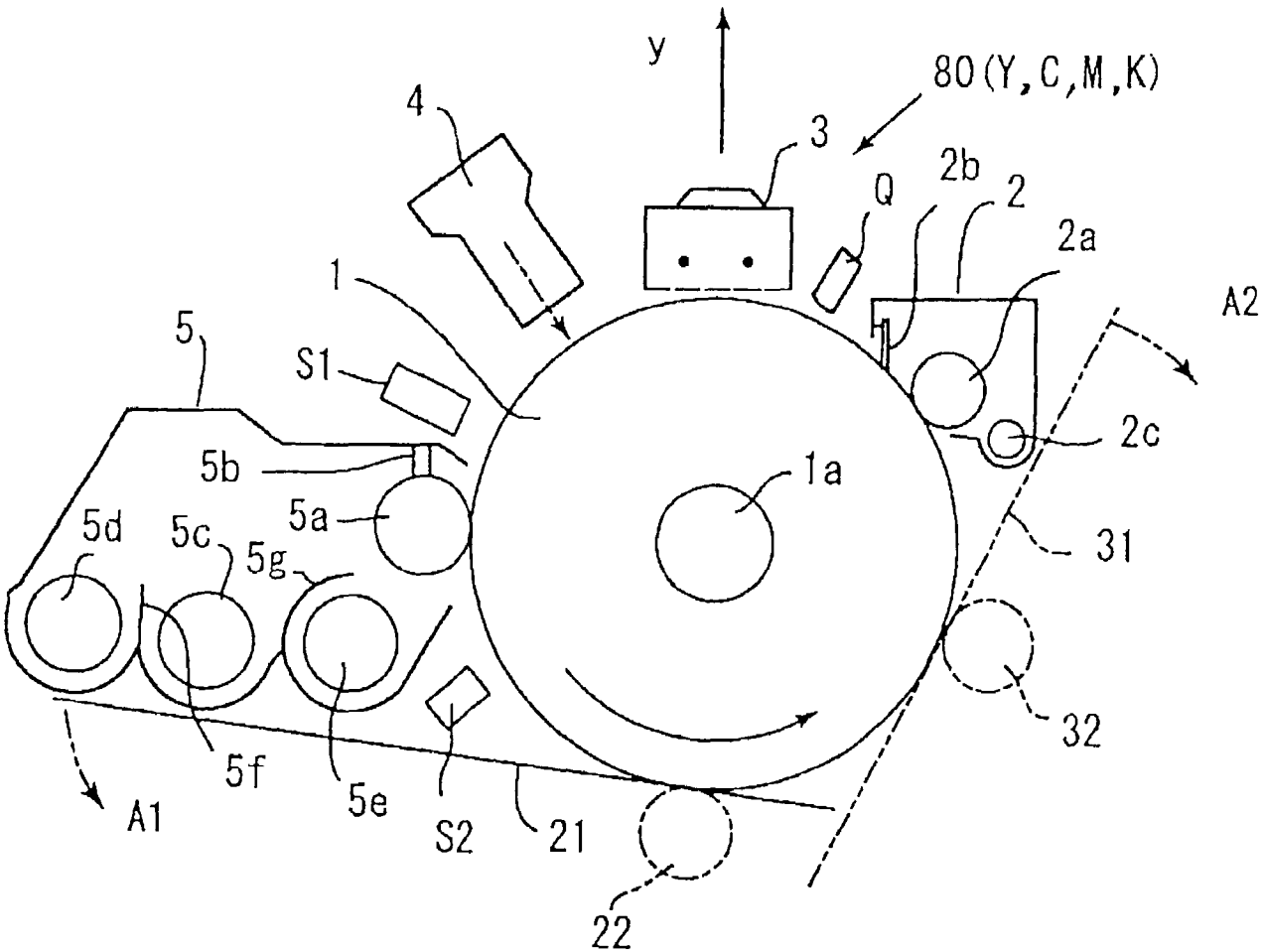
FIG. 18 is a figure showing a schematic configuration of an image forming unit that is used in the image forming apparatus shown in FIG. 17.

The four first image forming units 80Y, 80C 80M and 80K and the four second image forming units 81Y, 81C, 81M and 81K have the same configuration, and FIG. 18 shows a configuration example of one image forming unit. In FIG. 18, a scorotron charger, which is a charging device 3, an exposure device 4, a development apparatus 5, a cleaning device 2, an optical neutralizing device Q and other image creating members, a potential sensor S2, and an image sensor S2 are disposed, in accordance with an electrostatic printing process, around the cylindrical photoconductor 1 that is rotatably supported so as to be rotated in the direction of arrow by an unshown driving source when the image forming apparatus 100 is operated.

The photoconductor 1, which is the latent image supporting body, is obtained by forming an organic photosensitive layer (OPC) as a photoconductive material on, for example, an aluminum cylinder surface having a diameter of approximately 30 through 120 mm. Also, a photoconductor in which an amorphous silicon (a-Si) layer is formed can be adopted. Moreover, besides the cylindrical photoconductor, a belt-like photoconductor can be adopted.

As the charging device 3, not only a non-contact charger but also, for example, a charging roller, a charging brush or the like of the type that contacts with the surface of the photoconductor 1 can be adopted.

The cleaning device 2 has a cleaning brush 2*a*, a cleaning blade 2*b* and a recovering member 2*c*, and removes/recovers foreign matters such as residual toner formed on the surface of the photoconductor 1.

The exposure device 4 scans the light according to the image data of each color to the surface of the photoconductor 1 that has been already charged evenly by charging means, and forms an electrostatic latent image. The exposure device 4 shown in the figure is a line-shaped exposure device that uses an LED (light-emitting diode) array and is combined with an imaging element array. However, it is possible to adopt a laser scanning exposure device that uses a laser light source, a polygon mirror, a scanning imaging optical system and the like and irradiates the photoconductor with a laser beam that is modulated in accordance with the image data to be formed.

The development apparatus 5 of the present embodiment uses a development system that adopts a two-component developer composed of toner and carrier. An electrostatic latent image of each color, which is formed on the surface of the photoconductor 1 by exposing the negatively-charged photoconductor 1 to light, is developed with a toner of a predetermined color having the same polarity (minus polarity) as the charging polarity of the photoconductor 1 and visualized. This process is so called "reversal development."

The development apparatus 5 is of the triaxially-conveying type and is constituted by, in the example shown, a developing roller (only the sleeve is shown) 5*a*, which is the developer supporting body, a doctor 5*b*, which is a developer regulating member, a supplying/conveying screw 5*c* (same as the first screw 402 described above), which is the developer supplying/conveying member, a stirring/conveying screw 5*d* (same as the second screw 403 described above), which is the developer stirring/conveying member, a recovering/conveying screw 5*e*, and partition plates 5*f*, 5*g*, but the configuration of the development apparatus 5 is not limited to this configuration. Specifically, as described above in detail about the development apparatus, the biaxially-conveying type development apparatus shown in, for example, FIG. 14 to which the above-described phase control mechanism is applied, or the triaxially-conveying type development apparatus shown in FIG. 15 and FIG. 16 to which the above-described phase control mechanism is applied may be used.

The first image supporting belt 21, which is the first intermediate transfer body that is supported by a plurality of rollers 23, 24, 25, 26 (two), 27, 28 and 29 and travels in a direction of the arrow, is provided in a lower section of each of the photoconductors 1Y, 1C, 1M and 1K in each of the first image forming units 80Y through 80K. The first image supporting belt 21 is in the form of an endless belt, and is extended and disposed so as to contact with a part of each photoconductor after a development process of the photoconductor is performed. Moreover, an inner peripheral section of the first image supporting belt 21 is provided with a primary transfer roller 22 that faces each of the photoconductors 1Y, 1C, 1M and 1K.

An outer peripheral section of the first image supporting belt 21 is provided with a cleaning device 20A that faces a roller 23. This cleaning device 20A removes foreign matters such as unwanted toner and paper dust that remain on the surface of the first image supporting belt 21.

A member associated with the first image supporting belt 21 is integrally constituted as the first image supporting body unit 20, and is detachable with respect to the image forming apparatus 100.

The second image supporting belt 31, which is the second intermediate transfer body that is supported by a plurality of rollers 33, 34, 35, 36 (two), 37 and 38 and travels in a direction of the arrow, is provided so as to contact with each of the photoconductors 1Y, 1C, 1M and 1K in each of the second image forming units 81Y through 81K. The second image supporting belt 31 is in the form of an endless belt, and is extended and disposed so as to contact with a part of each photoconductor after a development process of the photoconductor is performed. An inner peripheral section of the second image supporting belt 31 is provided with a primary transfer roller 32 that faces each of the photoconductors 1Y, 1C, 1M and 1K.

An outer peripheral section of the second image supporting belt 31 is provided with a cleaning device 30A that faces a roller 33. This cleaning device 30A removes foreign matters such as unwanted toner and paper dust that remain on the surface of the second image supporting belt 31.

A member associated with the second image supporting belt 31 is integrally constituted as the second image supporting body unit 30, and is detachable with respect to the image forming apparatus 100.

Furthermore, a first secondary transfer roller 46 is provided in the vicinity of the supporting roller 28 in the outer periphery of the first image supporting belt 21. A bias is applied to the first secondary transfer roller 46 while causing a recording material ("paper P" hereinafter) to pass between the first image supporting belt 21 and the secondary transfer roller 46, whereby an image that is formed by the toner supported by the first image supporting belt 21 is transferred onto the paper P.

A transfer charger 47, which is second secondary transfer means, is provided in the vicinity of the supporting roller 34 in the outer periphery of the second image supporting belt 31. The transfer charger 47 is of a known type, wherein a thin wire made of tungsten or metal is formed as a discharging electrode, which is supported by a casing, and transfer current is applied from an unshown power source to this discharging electrode. The transfer current is applied while causing the paper P to pass between the image supporting belt 31 and the transfer charger 47, whereby an image that is formed by the toner supported by the second image supporting belt 31 is transferred onto the paper P. The polarity of the transfer current applied to the transfer roller 46 and the transfer charger 47 is the polarity of the toner and plus polarity opposite to the toner polarity, respectively.

A paper feeding device 40 that stores papers of various sizes so as to be able to supply these papers is disposed on the right side of the image forming apparatus 100, and a large paper feed tray 40*a* and a plurality of paper cassettes 40*b* through 40*d* are mounted in the paper feeding device 40. Further, only one piece of paper P is securely fed from the paper feed tray 40*a* and selected one of the plurality of paper cassettes 40*b* through 40*d*, by paper feeding/separating means 41A through 41D, and the paper P is then sent to a recording material conveying path 43B or a recording material conveying path 43A by a plurality of pairs of conveying rollers 42B.

An extension of the recording material conveying path 43A has recording material delivery means 50 for conveying a paper that has passed through the second image forming station to a fixing nip within a fixing device 60 provided in a downstream of a recording material conveying direction, with keeping the flat state of the paper. The recording material delivery means 50 has rollers 52, 53, 54, 55 and 56 for supporting a conveying belt 51 moving endlessly in a direction of the arrow. A cleaning device 50A facing a roller 55, an adhering charger 57 for adhering the recording material P against a roller 56, and a neutralizing/removing charger 58 facing the roller 54 are provided on the outside of the conveying belt 51.

The conveying belt 51 that moves along with the recording material P while contacting with an unfixed toner image is subjected to minus charging with the polarity same as the toner polarity by the adhering charger 57. A metal belt, polyimide belt, polyamide belt or the like can be adopted as the conveying belt 51. Mold-releasing characteristics can be provided between the surface and the toner, and chargeable resistance value is provided. The travel speed of the conveying belt 51 is combined with the travel speed of the recording material in the fixing device 60.

The fixing device 60 having heating means is provided on a downstream side of a paper conveying direction of the recording material delivery means 50. As this fixing device 60, a roller fixing device of a type that has a heater on the inside of the roller, a belt fixing device that causes a heated belt to travel, or a fixing device in which an electromagnetic induction heating system is adopted can be used.

In order to conform the colors of the images formed on both sides of the paper to the gloss level, the materials, hardness, and surface properties of the fixing roller and fixing belt are conformed at the top and bottom. Furthermore, the fixing conditions are controlled by unshown control means in accordance with a full-color image, monochrome image, or whether an image is formed on one side or both sides, and so as to obtain suitable fixing conditions in accordance with the type of the paper.

A pair of cooling rollers 70 that cools a paper on which fixation has been finished and has a cooling function for stabilizing the unstable toner promptly is provided on the conveying path after fixation. Rollers with a heat-pipe structure that has a discharging section can be adopted as the pair of cooling roller 70.

A pair of ejection rollers 71 ejects and stacks the cooled paper to an ejected-paper stack section 75 provided on the left side of the image forming apparatus 100. This ejected-paper stack section adopts a mechanism in which a receiving member is move up and down in accordance with stack level by an unshown elevator mechanism, so that a large amount papers can be stacked.

It should be noted that the paper can be caused to pass through the ejected-paper stack section 75 and conveyed toward another post-processing device. The post-processing device is a device used for book binding, such as a hole making device, a sheet cutting device, a folding device, or a stitching device.

Cartridges 86Y, 86C, 86M and 86K with respective colors, each of which stores a developer containing unused carrier, is detachably stored in a storage space 85. Unshown developer conveying means supplies the developer, if necessary, to the development apparatus of each of the image forming units. In the present embodiment, the configurations of the cartridges 86Y, 86C, 86M and 86K having respective colors are the same as the configurations of the four image forming units 80Y through 80K and four image forming units 81Y through 81K that are disposed at the top and bottom, but they can have different configurations. Also, the cartridge 86K for black toner, which is consumed most, can be of particularly large volume. This storage space 85 is located on the far side with respect to the conveying direction of the top surface of the image forming apparatus, and a flat surface section is secured on the near side of the top surface of the image forming apparatus, and thus can be used as a work table.

An operation of the image forming apparatus shown in FIG. 17 is described hereinafter.

[Operation for Recording on One Side of a Paper]

A one-side recording operation for forming a full-color image on one side of the recording material (paper) P is described in accordance with the above-described configuration.

Basically there are two types of one-side recording methods, and one of them can be selected. One of the two types is a method of directly transferring an image supported on the first image supporting belt 21 to one side of the paper P, while the other method is a method for directly transferring an image supported on the second image supporting bale 31 to one side of the paper. In the present embodiment, according to the configuration of the image forming apparatus 100, in the case in which the image supported on the first image supporting belt 21 is directly transferred to one side of the paper P, the image is formed on the top surface of the paper P, while in the case in which the image supported on the second image supporting belt 31 is directly transferred to one side of the paper P, the image is formed on the bottom surface of the paper P. Furthermore, if data to be recorded is recorded on a plurality of pages, it is advantageous to control an image creating sequence so that the pages are stacked properly on the ejected-paper stack section 75.

Therefore, there is described a method of recording the image data of the last page, causing the first image supporting belt 21 to support an image, and then transferring the image to the paper P so that the pages are arranged orderly.

Once the image forming apparatus 100 is activated, the first image supporting belt 21 and the photoconductors 1Y, 1C, 1M and 1K of the respective first image forming units 80Y through 80K are rotated. The second image supporting belt 31 is rotated at the same time, but the photoconductors 1Y, 1C, 1M and 1K of the respective second image forming units 81Y through 81K are separated from the second image supporting belt 31 and brought into a non-rotating state. First, image formation using the yellow image forming unit 80Y is started. The photoconductor 1Y is charged evenly by the charging device 3, and the light according to the image data for yellow that is outputted from the LED is emitted onto the surface of the charged photoconductor 1Y by activating the exposure device 4 constituted by the LED (light-emitting diode) array and the imaging element, whereby an electrostatic latent image is formed.

The electrostatic latent image is developed by the yellow toner by the developing roller 5*a* of the development apparatus 5 so as to make the image visible, and, by means of a transfer operation performed by the primary transfer roller 22, this latent image is primarily transferred electrostatically onto the first image supporting belt 21 that moves in synchronization with the photoconductor 1Y. The abovementioned latent image formation, development, and primary transfer operation are performed in the same manner in the photoconductors 1C, 1M and 1K of the cyan, magenta and black image forming units 80C, 80M and 80K sequentially at different times.

As a result, yellow, cyan, magenta and black toner images are superimposed on one another and supported as a full-color toner image on the first image supporting belt 21, and this toner image is moved along with the first image supporting belt 21 in a direction of the arrow.

At the same time with the abovementioned image formation operation, the paper P to be used for recording is reeled out by one of paper feeding/separating means 41A through 41D for feeding the paper, from the paper feed tray 40*a* or paper cassettes 40*b* through 40*d* provided in the paper feeding device 40. Then the paper P is conveyed to a recording material conveying path 43C by the pair of conveying rollers 42B, 42C. Before the leading end of the paper P is held between a pair of resist rollers 45, a jogger 44 operates so as to press both sides of the paper P from both lateral directions with respect to the conveying direction of the paper P, whereby position alignment of the paper lateral direction is carried out. The pair of resist rollers 45 are stopped, and the leading end of the paper P stops when entering the nip between the pair of resist rollers 45. However, the pair of resist rollers 45 are rotated at proper timing so that the image on the first image supporting belt 21 and the paper are positioned correctly, and then the paper P is conveyed to a transfer area.

This full-color toner image on the first image supporting belt 21 is transferred to the top surface of the paper P by a transfer operation performed by the secondary transfer roller 46, the paper P being conveyed in synchronization with the first image supporting belt 21. The polarity of a bias applied to the secondary transfer roller 46 is plus polarity opposite to the charging polarity of the toner.

Thereafter, the surface of the first image supporting belt 21 is cleaned by the belt cleaning device 20A. Moreover, the cleaning brush 2*a* and the cleaning blade 2*b* of the cleaning device 2 remove, from the surface of each of the photoconductors 1Y, 1C, 1M and 1K of the respective first image forming units 80Y through 80K in which the primary transfer is finished, foreign matters such as residual toner on the surface. The neutralizing device Q removes the residual potential on the surface of each photoconductor, to prepare for the next image creating/transferring step. The removed foreign matters such as the toner are sent to a recovering section 87 by recovery means 2*c*. It should be noted that the sensors S1 and S2 detect whether the potential on the photoconductor surface that is obtained after light exposure and the density of the toner adhered to photoconductor surface after the development process are appropriate or not, and output information to the unshown control means in order to set and control appropriate image creation conditions.

The paper P to which are secondarily transferred the toner images superimposed and supported on the first image supporting belt 21 is delivered toward the fixing device 60 by the conveying belt 51 of a conveying device 50. In order to securely deliver the paper P along with the conveying belt 51, the surface of the conveying belt 51 is charged by the paper adhering charger 57 in advance. The neutralizing/removing charger 58 is activated so that the paper P is removed from the conveying belt 51 and then securely sent to the fixing device 60.

The toners of respective colors that are superimposed on the paper P are subjected to fixing operation by the heat of the fixing device 60, then melted and mixed, whereby a complete color image is formed. In the case of the one side recording operation, only one side (top surface) of the paper P has the toner images, thus a small amount of heat energy is required for fixation, compared to a both side recording operation in which the both sides have the toner images. Therefore, the unshown control means optimally controls the electric power to be used by the fixing device, in accordance with the image.

The fixed toner images are rubbed by the guide member or the like of the conveying path before being adhered completely on the paper, thus deficient or damaged images may be obtained. In order to prevent such problems, the pair of cooling rollers 70 that are the cooling means are activated to cool the toners and the paper P. Thereafter, the paper P is ejected to the ejected-paper stack section 75 by the ejection rollers 71, with the image side up.

The image creating sequence is programmed in the ejected-paper stack section 75 such that the recorded matters on small-numbered pages are sequentially stacked, whereby the pages are arranged orderly. Also, the ejected-paper stack section 75 is designed to tilt downward as the number of ejected papers increases, thus the papers can be stacked securely and in an orderly fashion so that the order of the pages is not deteriorated.

Moreover, instead of directly stacking the recorded papers on the ejected-paper stack section 75, a hole-making process can be performed, or a sorter, a collator, a stitching device or a folding device can be used to convey the papers to the post-processing device.

It should be noted that other method of forming an image on one side of the paper P (recording on the bottom surface) performs the steps of forming images using the second image forming units 81Y through 81K, superimposing these images on the second image supporting belt 31, and primarily transferring the images, thus this method is different in that the image formation performed in the first image forming units 80Y through 80K is not performed and that the images are formed sequentially from the image data of small-numbered pages in order to arrange the pages orderly. However, these steps are basically the same as the one-side recording steps described above, thus the detailed description of these steps is omitted.

[Operation for Recording on Both Sides of a Paper]

Next, a two-side recording operation for forming a full-color image on both sides of the paper P is described.

When a start signal is inputted to the image forming apparatus, in substantially parallel with the process of the above-described one-side recording operation in which the images of the respective colors that are sequentially formed by the first image forming units 80Y, 80C, 80M and 80K are primarily transferred sequentially to the first image supporting belt 21 and supported the images as a first image, a process is performed in which the images with the respective colors that are sequentially formed by the second image forming units 81Y, 81C, 81M and 81K are primarily transferred sequentially to the second image supporting belt 31 and causing the belt to support these images as a second image.

The first and second image forming stations are arranged as shown in FIG. 17, thus, in order to conform the first image and the second image to a leading end of the conveying direction of the paper P in terms of position, formation of the second image is started after formation of the first image is started. Furthermore, the paper P is stopped and resent by the pair of resist rollers 45, thus paper feeding is performed in prospect of the time taken to stop and resent the paper, and position alignment is performed by the jogger 44.

The pair of resist rollers 45 transfer, at right timing, the paper P to a first transfer station constituted by the transfer roller 46, which is the first secondary transfer means, and the first image supporting belt 21. Transfer current with a plus polarity is applied to the transfer roller 46, and the image are transferred from the first image supporting belt 21 to one side of the paper P (top surface in the figure).

The paper P having the image on one side thereof as described above is then sent to a second transfer station having the transfer charger 47, which is the second secondary transfer means, by the conveying operation performed by the transfer roller 46. Then, transfer current having a plus polarity is applied to the charger, whereby the second image of full color that is supported on the second image supporting belt 31 beforehand is transferred on the bottom surface of the paper P at once.

The paper P having the full-color toner image transferred on both sides thereof as described above is delivered to the fixing device 60 by the conveying belt 51 of the conveying device 50. At this moment, the surface of the conveying belt 51 is charged by the paper adhering charger 57 using the minus polarity same as the polarity of the toner, so that unfixed toner on the bottom surface of the paper is prevented from being shifted to the conveying belt 51. Alternating current is applied to the neutralizing/removing charger 58, whereby the paper P is removed from the conveying belt 51 and delivered to the fixing device 60. The paper P is then subjected to the fixing operation by the heat of the fixing device 60, and the toner images on both sides of the paper P are melted and mixed. Subsequently, the paper P passes through the pair of cooling rollers 70 and ejected onto the ejected-paper stack section 75 by the ejection rollers 71.

In the case in which both-side recording is performed on a plurality of pages, the image creating sequence is controlled such that image on small-numbered pages are faced down and these pages are stacked on the ejected-paper stack section 75. Accordingly, when these pages are taken out and reversed, the recorded matters thereof are printed on the top of the first page, the back thereof as the second page, the second paper as the third page, and the back thereof as the fourth page, sequentially, whereby the order of the pages is aligned. The control means (not shown) executes such control of the image creating sequence and the control of increasing the electric power inputted by the fixing device more than when the one-side recording is performed.

The example of executing full-color recording has been described regarding the one-side recording operation and the two-side recording operation, but the image forming apparatus shown in FIG. 17 can perform using only the black toner and multi-color recording using two or three colors.

[Other Configuration of the Image Forming Apparatus]

Figure 19:
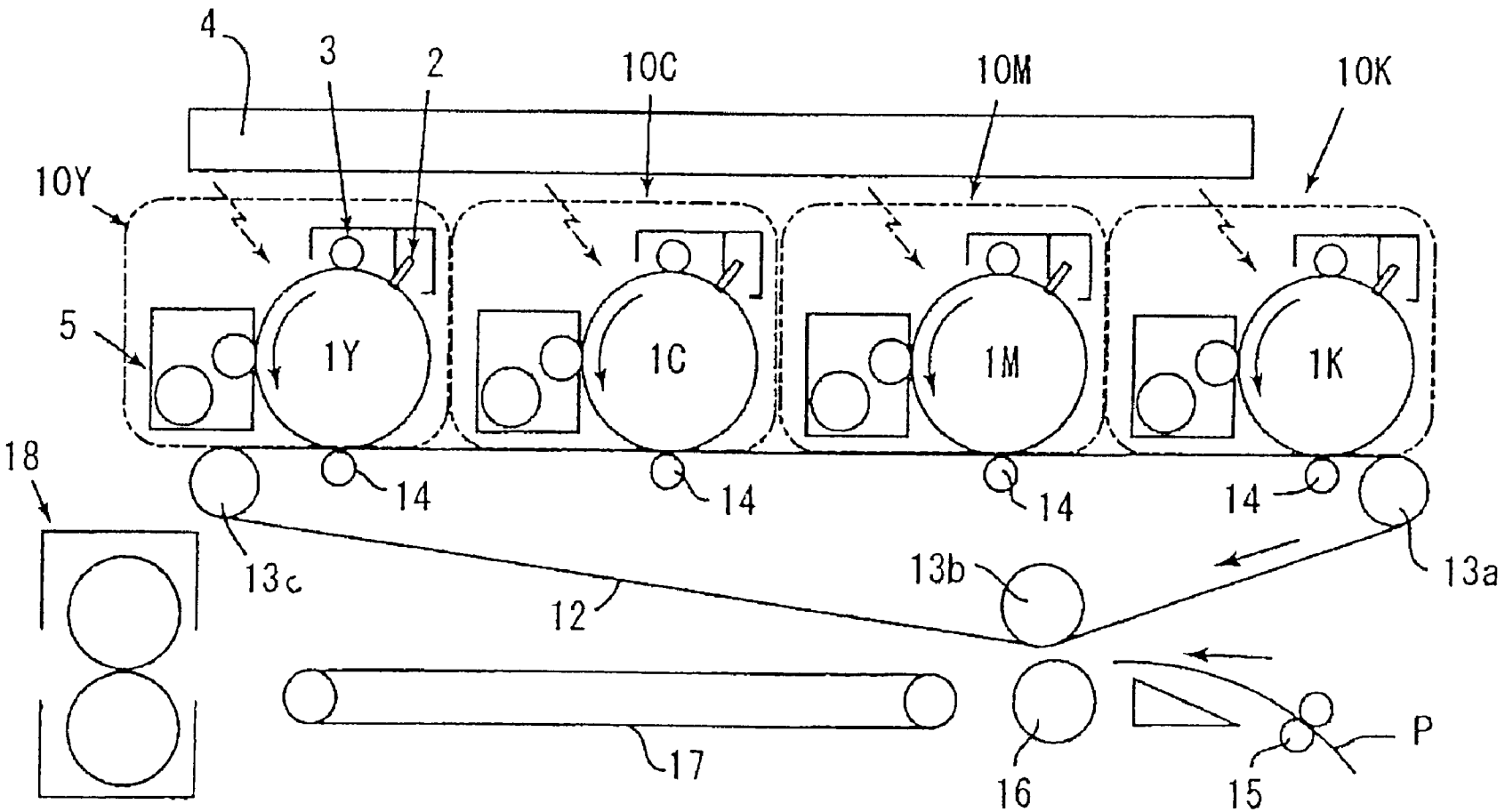
FIG. 19 is a cross-sectional view showing an internal configuration of another embodiment of the image forming apparatus to which the present invention is applied.

Next, an example of other configuration of the image forming apparatus according to the present invention is shown in FIG. 19.

This image forming apparatus is, unlike the one shown in FIG. 17, an image forming apparatus having a so-called tandem configuration, which is color system for creating an image on normal one side. The schematic configuration thereof is described hereinafter.

The color image forming apparatus shown in FIG. 19 is called "tandem system" and is configured such that process cartridges 10Y, 10C, 10M and 10K for the respective colors of yellow (Y), cyan (C), magenta (M) and black (K) are serially arranged along an intermediate transfer belt 12. The process cartridges 10Y through 10K for the respective colors have the same configuration, and each of them is constituted by the photoconductors 1Y through 1K, which are the latent image supporting bodies, charging device 3, development apparatus 5, cleaning device 2, and the like. The exposure device 4 and an intermediate transfer device 11 are disposed with respect to the photoconductors 1Y through 1K of the process cartridges 10Y through 10K, and an unshown paper feeding device, a paper conveying section, resist roller 15, paper transfer device 16, conveying device 17, fixing device 18 and the like are further provided.

As the charging device 3, for example, a contact-type charging roller or charging brush is used, but other non-contact charger can be used.

The cleaning device 2 has a cleaning brush, a cleaning blade and the like, and removes/recovers foreign matters such as residual toner formed on the surface of the photoconductor 1.

The exposure device 4 scans the light according to the image data of each color to the surface of the photoconductor 1 that has been already charged evenly by charging means, and forms an electrostatic latent image. The exposure device 4 shown in the figure is a laser scanning exposure device that uses four laser light sources, a polygon mirror, four types of scanning imaging optical systems and the like and irradiates the photoconductor with a laser beam that is modulated in accordance with the image data to be formed. However, an exposure device that is composed of an LED (light-emitting diode) array and an imaging element array can be adopted.

In the present embodiment, out of the components of the photoconductors 1, charging device 3, development apparatus 5, cleaning device 2 and the like, a plurality of them are integrally combined to configure each of the process cartridges, and these process cartridges 10Y through 10K are configured so as to be detachable with respect to the image forming apparatus main body.

Moreover, the configuration and the detail of the development apparatus 5 used in each of the process cartridges 10Y through 10K are as described above, that is, the one in which the abovementioned phase control mechanism is applied to, for example, the biaxially-conveying type development apparatus shown in FIG. 14, or the one in which the abovementioned phase control mechanism is applied to the triaxially-conveying type development apparatus shown in FIG. 15 and FIG. 16 can be used.

The intermediate transfer device 11 is constituted by the intermediate transfer belt 12 that is extended by a plurality of rollers 13*a*, 13*b* and 13*c* and rotated in a direction of the arrow shown, a primary transfer roller 14 which is the primary transfer means, a belt cleaning device which is not shown, and the like, wherein the toner images of the respective colors that are formed by the photoconductors 1Y through 1K of the process cartridges 10Y through 10K respectively are superimposed on one another sequentially and primarily transferred. The toner images transferred on the intermediate transfer belt 12 are secondarily transferred to the recording material (paper) P by the paper transfer device 16. The paper P obtained after the transfer is conveyed to the fixing device 18 by the conveying device 17, and the toner images are fixed onto the paper P.

It should be noted that the image creating operation performed in the image forming apparatus shown in FIG. 19 is the same as the one-side recording operation in which an image is not created on the backside (the second side), the one-side recording operation being performed in the image forming apparatus shown in FIG. 17, thus the detailed description of this operation is omitted herein.

[Characteristics of the Developer]

The carrier (magnetic carrier) of the two-component developer that is used in the development apparatus of the present invention is preferably have a volume average particle diameter of 20 through 60 μm. By using the carrier having an average particle diameter of 60 μm or less, the amount of developer to be drawn up can be reduced without reducing the development capacity, and the amount of developer to be circulated within the development apparatus can be reduced. Particularly, the amount of the developer that passes through the developer regulating member (doctor and the like) to which stress is applied can be reduced, contributing to the increase of the life of the development apparatus. Since the volume of the carrier is reduced, the size of the devices such as a carrier storage section can be reduced. In addition, the magnetic brush is densified in a development area, thus a high-quality image and stable quality can be achieved.

It should be noted that if the average particle diameter of the carrier is larger than 60 μm, the developer tends to overflow at a developer circulating section, whereby the developer cannot be circulated stably. On the other hand, if the average particle diameter of the carrier is smaller than 20 μm, the carrier adheres to the photoconductor, whereby a trouble occurs that the carrier scatters or may easily scatter from the development apparatus.

An SRA type microtrack particle size analyzer (manufactured by Nikkiso K.K.) is used to measure the average particle diameter of the carrier, and measurement range can be set at from 0.7 [μm] to 125 [μm].

[Characteristics of the Toner]

Regarding the toner characteristics of the two-component developer used in the development apparatus of the present invention, the volume average particle diameter of the toner is preferably 3 through 8 μm. By using a toner having a small particle diameter and sharp particle diameter, the space between toner particles becomes small, thus a required amount of toner to be adhered can be reduced without damaging the color reproducibility. Accordingly, density fluctuations related to development can be reduced. Also, stable reproducibility of a minute dot image of at least 600 dpi can be improved, and high quality that remains stable for a long period of time can be obtained. On the other hand, if the volume average particle diameter (D4) is less than 3 μm, the transfer efficiency and blade cleaning properties may deteriorate easily. If the volume average particle diameter (D4) exceeds 8 μm, a pile height of the image increases, and it becomes difficult to prevent characters or lines from scattering. Also, the ratio between the volume average particle diameter (D4) and the number average particle diameter (D1) (D4/D1) is preferably in a range of 1.00 through 1.40, and more preferably in a range of 1.00 through 1.30. The closer the value of (D4/D1) to 1.00, the sharper the particle size distribution.

By using such toner having small particle diameter and narrow particle size distribution, the charging amount distribution of the toner becomes uniform, and a high-quality image with less background fogging can be obtained. In an electrostatic transfer system, the transfer rate can be increased.

Next, a method of measuring the toner particle size distribution is described.

As a device for measuring the toner particle size distribution by means of a Coulter counter method, there are a Coulter Counter TA-11 and Coulter Multisizer 11 (both manufactured by Coulter Co., Ltd.). The measuring method is described hereinafter.

First, 0.1 through 5 ml of surfactant (preferably alkylbenzene sulfonate) is added as a dispersant to 100 through 150 ml of electrolytic solution. Here, the electrolytic solution is obtained by preparing an approximately 1% NaCl solution by using primary sodium chloride, and, for example, ISOTON-11 (manufactured by Coulter Co., Ltd.) can be used. Here, 2 through 20 mg of measurement sample is further added. The electrolytic solution having the sample suspended therein is subjected to a dispersion process for approximately 1 through 3 minutes in an ultrasonic distributor, and 100 μm of an aperture is used as an aperture by the measuring device to measure the number of toner particles and the volume of the toner and calculate the volume distribution and number distribution. The volume average particle diameter (D4) and number average particle diameter (D1) of the toner can be obtained from the resulted distributions.

As channels, thirteen channels between 2.00 through 2.52 μm; 2.52 through 3.17 μm; 3.17 through 4.00 μm; 4.00 through 5.04 μm; 5.04 through 6.35 μm; 6.35 through 8.00 μm; 8.00 through 10.08 μm; 10.08 through 12.70 μm; 12.70 through 16.00 μm; 16.00 through 20.20 μm; 20.20 through 25.40 μm; 25.40 through 32.00 μm; and 32.00 through 40.30 μm are used, and a particle having a diameter of 2.00 to 40.30 μm is used.

Figure 21:
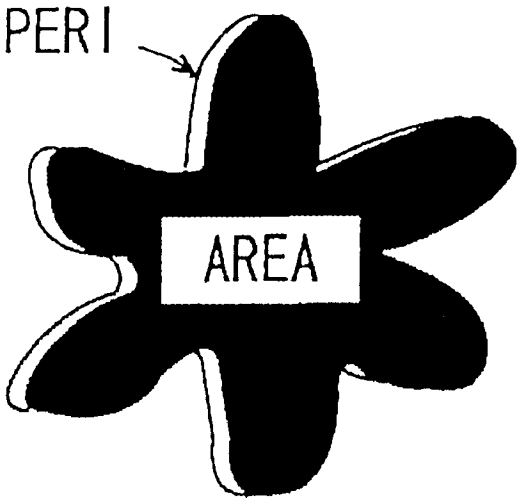
FIG. 21 is a figure schematically showing the shape of toner in order to explain a shape factor SF-2.
Figure 20:
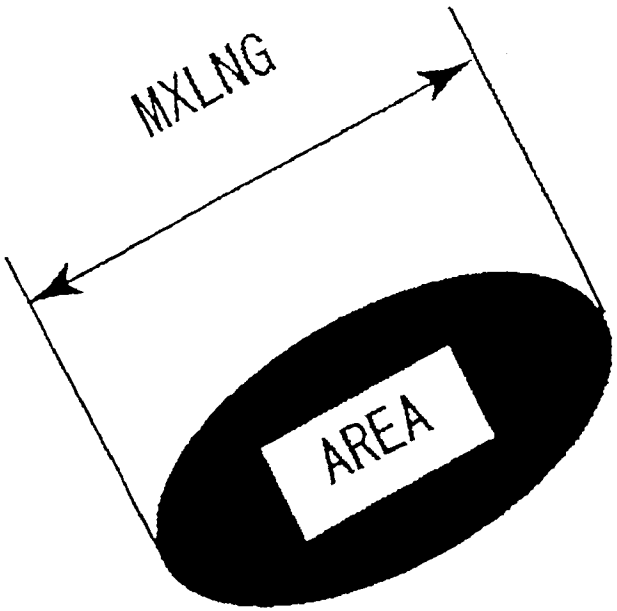
FIG. 20 is a figure schematically showing the shape of toner in order to explain a shape factor SF-1.

The shape factor SF-1 of the toner is preferably in a range of 100 through 180, and the shape factor SF-2 is preferably in a range of 100 through 180. FIG. 20 and FIG. 21 schematically show the shape of the toner in order to describe the shape factor SF-1 and the shape factor SF-2. The shape factor SF-1 indicates the rate of roundness of the toner shape, and is expressed by an equation (1) below. This equation shows a value that is obtained by dividing the second power of the maximum length MXLNG of a shape formed by projecting the toner onto a two-dimensional flat surface, by a figure area AREA, and multiplying thus obtained result by 100Π/4.

$$SF\text{-}1=\{(MXLNG)^2/\mathrm{AREA}\}\times(100\Pi/4) \quad \text{Eq. (1)}$$

In the case in which the value of this shape factor SF-1 is 100, it means that the toner shape is a true sphere. The toner shape becomes irregular as the value of the SF-1 increases.

Also, the shape factor SF-2 indicates the rate of unevenness of the toner shape, and is expressed by an equation (2) below. This equation shows a value that is obtained by dividing the second power of peripheral length PERI of a figure formed by projecting the toner onto a two-dimensional flat surface, by the figure area AREA, and multiplying thus obtained result by 100/4Π.

$$SF\text{-}2=\{(PERI)^2/\mathrm{AREA}\}\times(100/4\Pi) \quad \text{Eq. (2)}$$

In the case in which the value of this shape factor SF-2 is 100, it means that convex and concave are not formed on the toner surface, and the unevenness of the toner surface becomes more apparent as the value of the SF-2 increases.

In the measurement of the shape factors, specifically, a picture of the toner is taken by a scanning electron microscope (S-800: manufactured by Hitachi, Ltd.), and this picture is introduced to an image analyzer (LUSEX3: manufactured by Nireco Corporation) to analyze the picture, whereby the shape factors are calculated.

As the shape of the toner becomes nearly a spherical shape, the contact state between toner particles becomes a point-to-point contact state, whereby the adhesion force between toner particles weakens, and therefore the toner has a good fluidity. Consequently, the circularity of the developer is improved, whereby less stress is applied, and one-way circulation that is stable for a long period of time can be performed. Moreover, since the contact sate between the toner and the photoconductor becomes a point-to-point contact state, whereby the adhesion force between the toner and the photoconductor weakens, and therefore the transfer rate improves, contributing to the improvement of the image quality. On the other hand, if either one of the shape factors SF-1 and SF-2 exceeds 180, the fluidity is worsened and the circularity of the developer is also worsened. Furthermore, the transfer rate is reduced.

The toner of the present invention is obtained by adhering fine particles having an average primary particle diameter of 50 through 500 μm and a bulk density of at least 0.3 g/cm$^3$ (simply called "fine particles" hereinafter) to a particle surface of the toner. It should be noted that silica or the like is usually used as a normal fluidity improver, and, for example, the average primary particle diameter of the silica is normally 10 through 30 nm and the bulk density is 0.1 through 0.2 mg/cm$^3$.

In the present invention, since the toner surface has fine particles having appropriate characteristics, an appropriate gap is formed between a toner particle and a target object. Also, the contact area between the fine particles and the toner particles, photoconductor and charging applying member is extremely small, thus uniform contact can be obtained, whereby the effect of reducing the adhesion force increases, and the development/transfer efficiency an be effectively improved. Moreover, the fluidity of the developer improves, whereby the effect of reducing the stress can be obtained, contributing to the increase of the life of the development apparatus. In addition, the fine particles serve as a roller, thus the photoconductors are prevented from being worn out or damaged. Therefore, when cleaning is performed under high stress from the cleaning blade and photoconductors (high load, high speed, and the like), external additives are hardly immersed into the toner particles, or can be removed or recovered even when slightly immersed into the toner particles, thus the characteristics that are stable for a long period of time can be obtained. In addition, there is a so-called dam effect for adequately removing the developer from the toner surface, and accumulating the developer in a leading end section of the cleaning blade to prevent the occurrence of development where the toner passes through from the blade.

These characteristics indicate an operation of reducing the share of the toner particles, and thus exert an effect of reducing the filming of the toner itself using a low rheologic component contained in the toner, in order to perform high-speed fixation (low-energy fixation). Moreover, when using fine particles having an average primary particle diameter of 50 through 500 μm, excellent cleaning performance thereof can be utilized sufficiently, and the fluidity of the toner particles is prevented from decreasing, due to the extremely small particle diameter.

Also, although not specified, even if the fine particles that are subjected to the surface processing are externally adhered to the toner, and even in the case in which the carrier is contaminated, the degree of deterioration of the developer is small. Therefore, changes in the fluidity and charging characteristics of the toner become small over time, whereby stable developer circulation and development can be achieved for a long period of time. Moreover, the stability of the image quality is improved.

Fine particles having an average primary particle diameter (referred to as "average particle diameter" hereinafter) of 50 through 500 nm are used, and particularly the average particle diameter is preferably 100 through 400 nm. If the average particle diameter is less than 50 nm, the fine particles are immersed into concave sections of the uneven toner surface, whereby the roller characteristics may be deteriorated. On the other hand, if the average particle diameter is larger than 500 nm, and if the fine particles are placed between the blade and the photoconductor surface, the area of the fine particles becomes substantially the same as the contact area of the toner itself, causing cleaning failure in which the toner particles that should be cleaned pass through.

Also, if the bulk density is less than 0.3 mg/cm$^3$, the fluidity is improved, but dispersibility and adhesion of the toner and fine particles are increased, whereby the effect of the toner serving as a roller and the so-called dam effect of accumulating the developer in the cleaning section to prevent the toner cleaning failure are deteriorated.

Examples of inorganic compounds contained in the fine particles of the present invention include $SiO_2$, $TiO_2$ $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, $MgSO_4$, $SrTiO_3$ and the like, and preferably $SiO_2$, $TiO_2$, and $Al_2O_3$ can be used. Particularly, these inorganic compounds may be subjected to a hydrophobic treatment by means of various coupling agents, hexamethyldisilazane, dimethyldichlorosilane, octyl-trimethoxysilane, and the like.

Furthermore, the fine particles of organic compounds may be thermoplastic resin or thermohardening resin, and examples include vinyl resin, polyurethane resin, epoxy resin, polyester resin, polyamide resin, polyimide resin, silicone, phenol resin, melamine resin, urea resin, aniline resin, ionomer resin, polycarbonate resin, and the like. Two or more of the abovementioned resins may be combined and used as the resin fine particles. It is preferred that vinyl resin, polyurethane resin, epoxy resin, polyester resin, or a combination thereof be used because aqueous dispersing element of fine spherical resin can be obtained easily.

Specific examples of the vinyl resin include a polymer obtained by homopolymerizing or copolymerizing vinyl monomer, such as styrene-(meth)acrylate copolymer, styrene-butadiene copolymer, (meth)acrylic acid-acrylate copolymer, styrene-acrylonitrile copolymer, styrene-maleic anhydride copolymer, styrene-(meth)acrylic copolymer, and the like.

It should be noted that the bulk density of the fine particles was measured by means of the following method. The fine particles were gradually added using a 100 ml-measuring cylinder to obtain 100 ml of fine particles. At this moment, no vibration was applied. The bulk density was measured by the weight difference obtained before and after adding the fine particles in this measuring cylinder.

Bulk density (g/cm$^3$)=Amount of fine particles (g/100 ml)÷100

As a method of externally adding and adhering the fine particles of the present invention to the toner surface, there are a method mechanically mixing and adhering the toner host particles and fine particles by means of various known mixing devices, and a method of evenly dispersing the toner host particles and fine particles within a solution phase by means of surfactant or the like, performing an adhering process, and thereafter drying thus obtained matter.

[Developer Supplying Means]

Figure 22A:
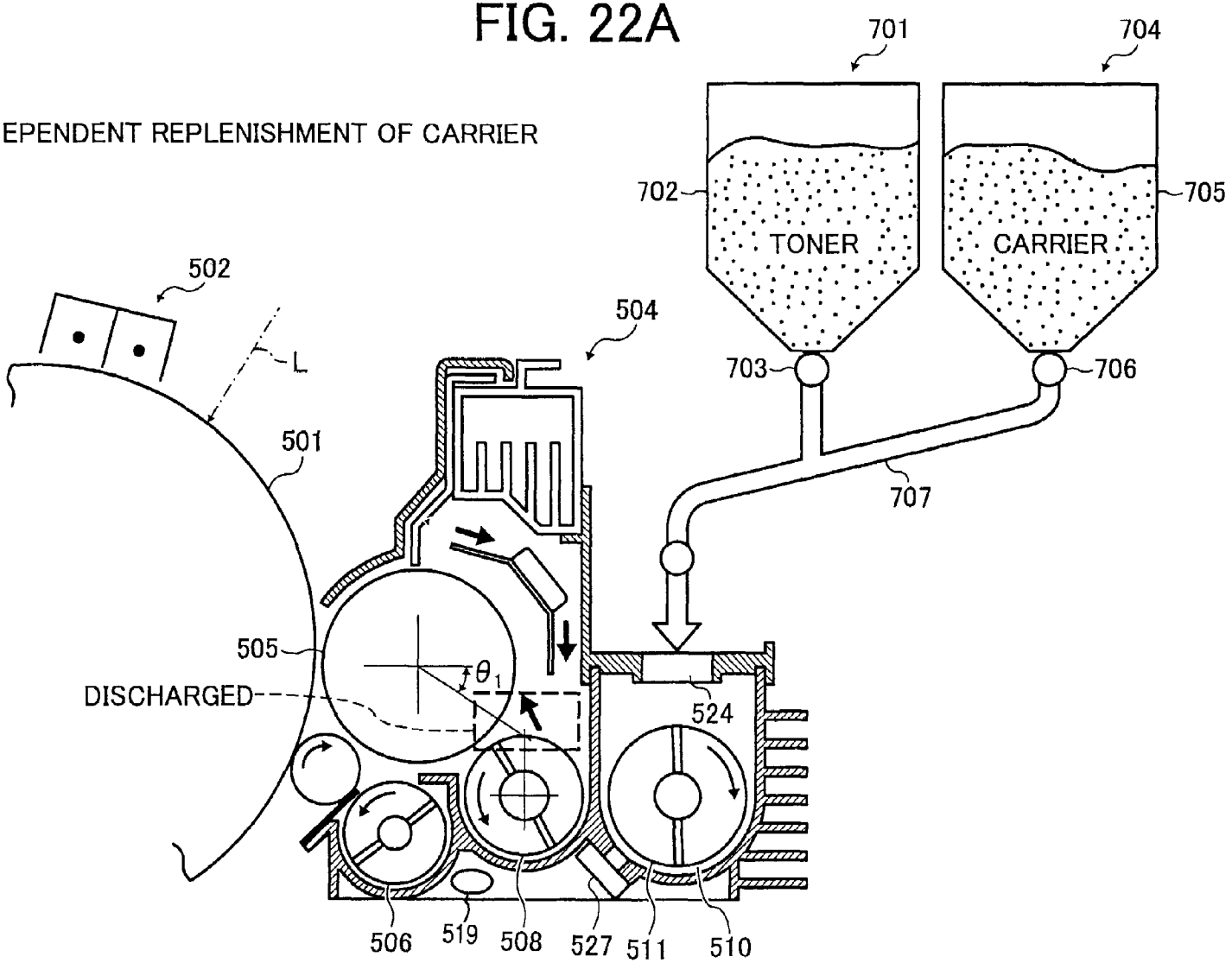
FIG. 22 is a figure showing a schematic configuration of developer supplying means of the development apparatus according to the present invention.
Figure 22B:
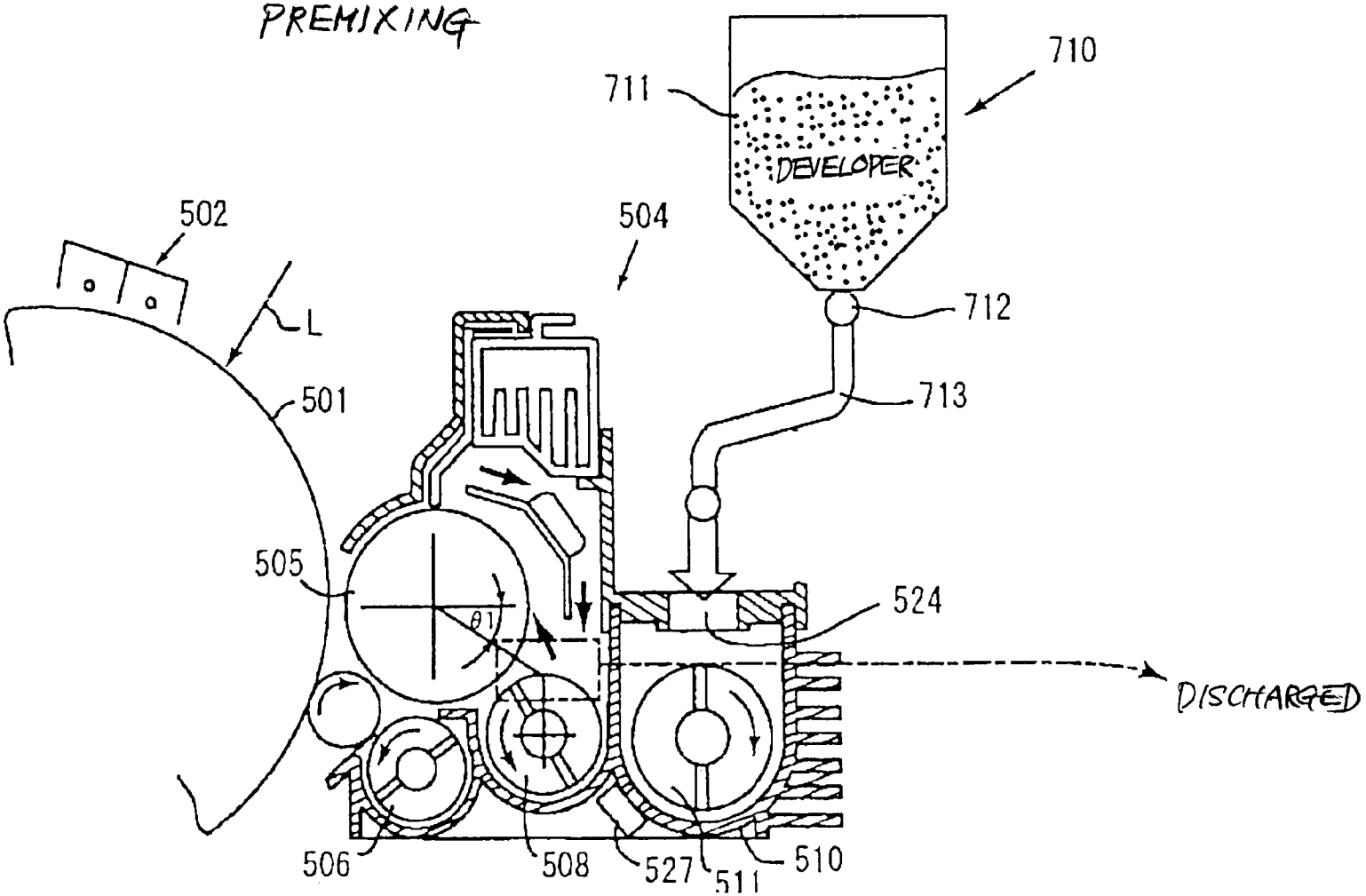

Next, FIGS. 22A and 22B show a configuration example of the development apparatus having the developer supplying means for supplying unused developer and the developer discharging means for discharging the developer deteriorated within the development apparatus to the outside of the development apparatus.

First, an example of the developer supplying means is described using FIG. 22A.

The developer supplying means is constituted by toner supplying means 701 having a toner storage container 702 in which unused toner is stored, toner replenishment control means 703, carrier supplying means 704 having a carrier storage container 705 in which unused carrier is stored, carrier replenishment control means 706, and a developer supplying/conveying path 707. The toner storage container 702 and the carrier storage container 705 merge with each other in the middle of the conveying path where the developer is conveyed, and are connected to a developer supplying port 524 of a development apparatus (e.g., the development apparatus having the configuration shown in FIG. 15) 504. The amount of toner to be replenished is controlled by the toner supplying means 701, and the amount of carrier to be replenished is controlled by the carrier supplying means 704.

The toner supplying means 701 and the carrier supplying means 704 are configured such that, for example, a hole is formed on a rotating body, a shutter is opened and closed by the rotation of the rotating body, and the amount of toner or carrier to be replenished s controlled by the number of rotations.

The toner density sensor 527 is provided in a lower part of the stirring/conveying path 510 of the development apparatus 504, and developer replenishment control is performed by means of a sensor output. The amount of toner to be replenished is controlled by the toner consumption amount of an image, and the carrier is replenished in accordance with the degree of deterioration of the toner. Also, when the carrier is replenished, the developer discharging means 519 discharges deteriorated developer to a discharging section outside the apparatus.

This method is advantageous in allocation of the inner components of the image forming apparatus, because the place to install the toner cartridges is not restricted. Also, since the toner can be replenished on a timely basis, it is not necessary to provide a large toner storage space in the development apparatus, whereby minimization of the development apparatus can be achieved.

Next is described a case in which the developer supplying means is used as the supplying means shown in FIG. 22B.

Developer supplying means 710 is constituted by a developer storage container 711 in which unused developer (developer in which toner and carrier are mixed beforehand) is stored, developer replenishing means 712, and a developer supplying/conveying path 713, and is connected to the developer supplying port 524 of the development apparatus (e.g., the development apparatus having the configuration shown in FIG. 15) 504.

Here, in the unused developer, toner having a toner weight ratio (toner density) of approximately 15 wt % is immixed. It should be noted that the value of the toner density is not limited, and thus is appropriately set along with the capacity of the development apparatus or storage containers, as well as a set life. The amount of developer to be replenished is controlled by replenishing means. The developer replenishing means 712 can use, for example, a uniaxial eccentric screw pump (mono pump). The toner density sensor 527 is provided in a lower part of the stirring/conveying path of the development apparatus 504, and developer replenishment control is performed by means of a sensor output. When the developer is replenished, the developer discharging means (augers, screws, coils, screw pumps or the like that are not shown) discharges the used developer within the apparatus to the discharging section outside the apparatus.

This method is advantageous in allocation of the inner components of the image forming apparatus, because the place to install the toner cartridges is not restricted. Also, since the developer can be replenished on a timely basis, it is not necessary to provide a large developer storage space in the development apparatus, whereby minimization of the development apparatus can be achieved.

According to the present invention, the development apparatus using the two-component developer is provided with the phase control mechanism that intentionally forms a dividing point in the flow of the developer, causes thus obtained divided developers to pass through different paths, thereby shifts a phase of the toner density fluctuation in the developer, and thereafter causes the developers with shifted phases to merge with each other again. By controlling the phase, the toner density can be uniformed instantly, thus fluctuation of the toner density and variation of the toner charging amount can be sufficiently inhibited before the developer is drawn up to the developer supporting body (e.g., the sleeve).

Various modifications will become possible for those skilled in the art after receiving the teachings of the present disclosure without departing from the scope there of.

What is claimed is:

1. A development apparatus for developing and visualizing a latent image formed on a latent image supporting body, by using a two-component developer composed of toner and carrier, comprising:

a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control;

two developer conveying members configured to convey the developer in different directions from each other; and a partition plate disposed between the two developer conveying members, wherein developer passing sections on both ends in axial directions of the pair of developer conveying members, and a single opening section is provided as the phase control mechanism on the partition plate, wherein a center position x of the opening section on the partition plate is located within a distance of $(\frac{1}{8}+\frac{1}{2}\cdot n)\lambda \leqq x \leqq (\frac{3}{8}+\frac{1}{2}\cdot n)\lambda$ ($\lambda$: a wavelength that indicates a toner density fluctuation on each of the developer conveying members, n=0, 1, 2, . . . ) from a center position of an opening section of an end section of the development apparatus.

2. The development apparatus as claimed in claim 1, further comprising:

a developer supporting body configured to rotate while supporting the developer and supply the toner of the developer to a latent image formed on the latent image supporting body at a position facing the latent image supporting body to perform developments, wherein the two developer conveying members are disposed in parallel with the developer supporting body.

3. The development apparatus as claimed in claim 2, wherein the two developer conveying members are screw-like members, each of which has a spiral blade section at a rotation axis section and conveys the developer in the axial direction by being rotated, and either one or both of the two developer conveying members facing the opening section on the partition plate are attached with fins.

4. The development apparatus as claimed in claim 1, wherein, in the case in which the wavelength $\lambda$ varies due to the difference in developer conveying speed between the two developer conveying members, the wavelength $\lambda$ is obtained as an average value of wavelengths $\lambda\mathbf{1}$ and $\lambda\mathbf{2}$ of the toner density fluctuations on the both developer conveying members: $\lambda=(\lambda\mathbf{1}+\lambda\mathbf{2})/2$.

5. The development apparatus as claimed in claim 2, wherein the opening section of the partition plate is openable and closable.

6. The development apparatus as claimed in claim 5, wherein opening/closing of the partition plate is controlled in accordance with a toner replenishment timing.

7. The development apparatus as claimed in claim 2, wherein when the developer conveying member of the two developer conveying members, which is located proximate to the developer supporting body, is taken as a first developer conveying member, and the other developer conveying member that is located distant from the developer supporting body is taken as a second developer conveying member, a rotation direction of the second developer conveying member is a clockwise rotation, when viewed from a side of a state in which the developer supporting body is disposed on the left and the second developer conveying member on the right.

8. The development apparatus as claimed in claim 2, wherein the distance between an end section of the partition plate and a side face of a case is at least twice an external diameter of each of the developer conveying members.

9. The development apparatus as claimed in claim 2, wherein, when the developer conveying member of the pair of developer conveying members, which is located proximate to the developer supporting body, is taken as a first developer conveying member, the relationship among the amount per unit time of the developer X[kg/s] falling from a developer pool of the developer supporting body onto the first developer conveying member, the weight per unit length of the developer Y[kg/m] on the first developer conveying member, and the speed of conveying the developer on the first developer conveying member u[m/s] satisfies $X/u \geqq \frac{1}{2}\cdot Y$.

10. The development apparatus as claimed in claim 9, wherein, when the weight per unit length of the developer on the first developer conveying member fluctuates according to location, an average value of the weight per unit length of the developer in a longitudinal direction is expressed as the developer weight Y[kg/m].

11. The development apparatus as claimed in claim 9, further comprising:

a developer regulating member that regulates the thickness of the developer of the developer pool formed on the developer supporting body; and excess developer recovering means for recovering excess developer formed in the vicinity of the developer regulating member, wherein the excess developer recovering means returns recovered developer to a conveying path of the first developer conveying member, and returns at least some of the developer from a recovered position to an upstream side of the conveying direction of the first developer conveying member.

12. The development apparatus as claimed in claim 11, wherein, when the excess developer is returned from the position where the developer is recovered by the excess developer recovering means to the upstream side of the conveying direction of the first developer conveying member, the relationship among a distance x between the recovered position and a returned position, an average time t between when the developer is drawn up to the developer pool of the developer supporting body and when the developer falls onto the first developer conveying member, and the speed u of conveying the developer positioned on the first developer conveying member satisfies $\lambda/4+\lambda\cdot n \leqq u\cdot t+x \leqq 3\lambda/4+\lambda\cdot n$ ($\lambda$: a wavelength that indicates a toner density fluctuation on the first developer conveying member).

13. The development apparatus as claimed in claim 1, further comprising:

a developer supporting body configured to rotate while supporting the developer and supply the toner of the developer to a latent image formed on the latent image supporting body at a position facing the latent image supporting body, to perform development, wherein the two developer conveying members are disposed in parallel with the developer supporting body, one of which is for supplying and recovering the developer to and from the developer supporting body, and the other one is for conveying and stirring the developer after the toner is replenished, wherein the two developer conveying members are disposed in a horizontal direction below the developer supporting body.

14. The development apparatus as claimed in claim 1, further comprising:

a developer supporting body that rotates while supporting the developer, and supplies the toner of the developer to a latent image formed on the latent image supporting body at a position facing the latent image supporting body, to perform development; and three developer conveying members, (i) a supplying developer conveying member that is disposed in parallel with the developer supporting body and supplies the developer to the developer supporting body, (ii) a recovering developer conveying member that recovers the developer from the developer supporting body after development and conveys the recovered developer in a direction parallel with and same as the direction of the supplying developer conveying member, (iii) and a stirring developer conveying member that stirs and conveys excess developer, which is not supplied from the supplying developer conveying member to the developer supporting body, and the developer conveyed from the recovering developer conveying member, in a direction opposite to that of the supplying developer conveying member.

15. The development apparatus as claimed in claim 1, further comprising:

developer supplying means for supplying unused and previously mixed developer; and developer discharging means for discharging the developer within the development apparatus to the outside of the development apparatus.

16. The development apparatus as claimed in claim 1, further comprising:

developer supplying means constituted by a carrier supply section that supplies unused carrier and a toner supply section that supplies unused toner, wherein an operation for replenishing the carrier and an operation for replenishing the toner are controlled independently.

17. A process cartridge which integrally has a latent image supporting body, a surface of which is formed with an electrostatic latent image, and a development apparatus that develops and visualizes the electrostatic latent image formed on the latent image supporting body, by using a two-component developer composed of toner and carrier, wherein the development apparatus includes:

a phase control mechanism, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control;

two developer conveying members configured to convey the developer in different directions from each other; and a partition plate disposed between the two developer conveying members, wherein developer passing sections on both ends in axial directions of the pair of developer conveying members, and a single opening section is provided as the phase control mechanism on the partition plate, wherein a center position x of the opening section on the partition plate is located within a distance of $(1/8+1/2\cdot n)\lambda \leqq x \leqq (3/8+1/2\cdot n)\lambda$ ($\lambda$: a wavelength that indicates a toner density fluctuation on each of the developer conveying members, n=0, 1, 2, . . . ) from a center position of an opening section of an end section of the development apparatus.

18. An image forming apparatus, comprising:

a latent image supporting body, a surface of which is formed with an electrostatic latent image;

a development apparatus that develops and visualizes the electrostatic latent image formed on the latent image supporting body, by using a two-component developer composed of toner and carrier, or a process cartridge that integrally has the latent image supporting body and the development apparatus, wherein the development apparatus includes:

a phase control mechanism forming, which forms a dividing point at a predetermined point in a flow of a developer within the development apparatus in which a toner density fluctuates spatially due to toner replenishment or toner consumption caused by development, causes the developer divided at the dividing point to pass through different paths, thereby shifts a phase of the fluctuation of the toner density within the developer, and thereafter causes thus obtained developers having shifted phases to merge with each other, to perform phase control;

two developer conveying members configured to convey the developer in different directions from each other; and a partition plate disposed between the two developer conveying members, wherein developer passing sections on both ends in axial directions of the pair of developer conveying members, and a single opening section is provided as the phase control mechanism on the partition plate, wherein a center position x of the opening section on the partition plate is located within a distance of $(1/8+1/2 \cdot n)\lambda \leqq x \leqq (3/8+1/2 \cdot n)\lambda$ ($\lambda$: a wavelength that indicates a toner density fluctuation on each of the developer conveying members, n=0, 1, 2, . . . ) from a center position of an opening section of an end section of the development apparatus.

19. The image forming apparatus as claimed in claim 18, further comprising:

a plurality of development apparatuses or process cartridges having different developing colors, wherein a color image is formed on a recording material.

20. The image forming apparatus as claimed in claim 18, further comprising:

a plurality of image forming units or process cartridges that have at least the latent image supporting body and the development apparatus that develops the electrostatic latent image formed on the latent image supporting body, wherein an image having different developing colors is formed by means of each of the image forming units or process cartridges, the image is transferred onto the recording material directly or by means of an intermediate transfer body, and thereby a color image is formed on the recording material.

21. The image forming apparatus as claimed in claim 18, further comprising:

a first image forming station that is constituted by a first image forming unit group in which are arranged a plurality of image forming units each having at least an image supporting body and a development apparatus for developing an electrostatic latent image formed on the image supporting body, and a first intermediate transfer body for transferring and supporting a first toner image formed by the first image forming unit group; and a second image forming station that is constituted by a second image forming unit group in which are arranged a plurality of image forming units each having at least an image supporting body and a development apparatus for developing an electrostatic latent image formed on the image supporting body, and a second intermediate transfer body for transferring and supporting a second toner image formed by the second image forming unit group, wherein the first toner image to be transferred to a first surface of the recording material is formed by the first image forming station, the second toner image to be transferred to a second surface of the recording material is formed by the second image forming station, and the first toner image and the second toner image are transferred simultaneously or sequentially to the recording material before being fixed.

* * * * *